US005695608A

United States Patent [19]

Yagi et al.

[11] Patent Number: 5,695,608

[45] Date of Patent: Dec. 9, 1997

[54] MOISTURE-PROOF PAPER SHEET

[75] Inventors: Hisanori Yagi; Takashi Kawamukai; Hiromi Uchida; Hideyuki Mikado; Shinichi Koga, all of Tokyo, Japan

[73] Assignee: New Oji Paper Co., Inc., Tokyo, Japan

[21] Appl. No.: 715,969

[22] Filed: Sep. 19, 1996

[30] Foreign Application Priority Data

| | | | |
|---|---|---|---|
| Sep. 22, 1995 | [JP] | Japan | 7-244610 |
| Dec. 19, 1995 | [JP] | Japan | 7-330251 |
| Feb. 28, 1996 | [JP] | Japan | 8-041367 |

[51] Int. Cl.[6] ..... D21H 27/00

[52] U.S. Cl. ..... 162/135; 162/164.1; 427/391; 428/336; 428/323; 428/331

[58] Field of Search ..... 162/135, 136, 162/137, 164.1; 106/491, 483, DIG. 3; 427/391, 209, 411, 393.5; 428/327, 511, 336, 323, 207, 331

[56] References Cited

U.S. PATENT DOCUMENTS

| | | | |
|---|---|---|---|
| 3,240,203 | 3/1966 | Dye | 125/24 |
| 3,463,350 | 8/1969 | Unger | 220/83 |
| 3,663,260 | 5/1972 | Poppe et al. | 117/47 |
| 4,082,880 | 4/1978 | Zboril | 428/220 |
| 4,265,977 | 5/1981 | Kawamura et al. | 428/511 |
| 4,278,583 | 7/1981 | Sekiya | 428/511 X |
| 4,341,839 | 7/1982 | Shaw et al. | 428/342 |
| 4,370,389 | 1/1983 | Ogura et al. | 428/511 |
| 4,448,923 | 5/1984 | Reeb et al. | 524/460 |
| 4,528,235 | 7/1985 | Sacks et al. | 428/220 |
| 5,270,103 | 12/1993 | Oliver et al. | 428/219 |
| 5,275,846 | 1/1994 | Imai et al. | 427/362 |
| 5,378,275 | 1/1995 | Shiraga et al. | 106/417 |
| 5,500,191 | 3/1996 | DeMatte | 427/358 |

FOREIGN PATENT DOCUMENTS 55-30419-A 3/1980 Japan .

OTHER PUBLICATIONS

The American Chemical Society, Barrier Polymers and Structures–Chapter 11, "Performance of High–Barrier Resins with Platelet–Type Fillers", pp. 224–228, T. C. Bissot.

*Primary Examiner*—Donald E. Czaja
*Assistant Examiner*—Jose A. Fortuna
*Attorney, Agent, or Firm*—Nikaido Marmelstein Murray & Oram LLP

[57] ABSTRACT

A moisture-proof paper sheet comprising a moisture-proof coating layer formed on a paper sheet substrate and comprising (a) a moisture-proof, film-forming synthetic resin (for example, carboxyl-modified SBR resin), (b) plate crystalline phyllosilicate compound particles with an average size of 5 to 50 μm and an aspect ratio of 5 or more and (c) a moisture-proofness-enhancing agent, for example, urea-formaldehyde condensation reaction products, organoalkoxysilane compounds, or polyamidepolyurea compounds, has an enhanced resistance to water vapor permeation and, after use, the waste moisture-proof paper sheet can be easily re-pulped and recycled.

8 Claims, No Drawings

MOISTURE-PROOF PAPER SHEET

BACKGROUND OF THE INVENTION

1. Field of the Invention

The present invention relates to a moisture-proof paper sheet. More particularly, the present invention relates to a moisture-proof paper sheet having a moisture-proofing coating layer formed on a paper sheet substrate and having a specific composition and an enhanced moisture resistance, and being capable of being re-pulped and recycled after using.

The moisture-proof paper sheet of the present invention is useful as moisture-proof wrapping paper sheet, water resistant paper sheet or moisture-proof double bag.

2. Description of the Related Art

It is well known that moisture-proof paper sheets having a coating layer formed on at least one surface of a paper sheet substrate and made from a hydrophobic film-forming resin, for example, polyethylene, polypropylene or a polyvinylidene chloride, can prevent permeation of water or water vapor therethrough. The conventional moisture-proof paper sheets are advantageous in that the moisture resistant coating layer is strong and has a high moisture-proofing property. Nevertheless, the conventional moisture-proof paper sheets are disadvantageous in that after use the resultant waste moisture-proof paper sheets cannot be satisfactorily re-pulped and recycled, because when the waste moisture-proof paper sheets are subjected to a re-pulping procedure, the moisture resistant coating layers remain in the form of thin films and the pulp fibers form a plurality of flocks and cannot be fully separated from each other. Thus, the waste conventional moisture-proof paper sheets must be burnt. This burning does not meet with the requirements of environmental protection and the recycling and re-use of natural materials. Also, if the usual waste paper sheets, which can be re-pulped and re-used, are mixed with the waste conventional moisture-proof paper sheet, it is very difficult to separate the usual waste paper sheets from the mixture, and thus the efficiency of recycling and re-using waste paper sheets significantly decreases.

To solve the above-mentioned problems, various attempts have been made. For example, Japanese Unexamined Patent Publication No. 50-36,711 discloses a process for producing moisture-proof paper sheets by coating a kraft paper sheet with an aqueous emulsion having a specific composition and containing a paraffin wax, heat-drying the coated emulsion layer, the resultant moisture-proof paper sheet being capable of being re-pulped and recycled after use. Also, Japanese Unexamined Patent Publication No. 56-148,997 discloses a composition for moisture-proof paper sheets, comprising a mixture of an aqueous emulsion prepared by dispersing a synthetic hydrocarbon resin and a wax in water with the aid of a styrene-maleic acid copolymer and a surfactant, with a thermoplastic acrylic resin emultion. The resultant moisture-proof paper sheet produced by forming a moisture resistant coating layer from the composition on a paper sheet substrate can be re-pulped and re-used, after use. Further, "Hoso Gijutsu", published on September, 1982, pages from 42 to 46, discloses a process for producing moisture-proof paper sheets by coating a paper sheet substrate with a coating liquid containing a specific synthetic rubber latex and a specific wax emulsion. The resultant moisture-proof paper sheet can be re-pulped and re-used, after use.

As mentioned, the conventional wax-coated moisture-proof paper sheets can be re-pulped and re-used, after use.

Nevertheless, this type of moisture-proof paper sheet is disadvantageous in that when the wax-coated moisture-proof paper sheet is wound up into a roll form, the wax is transferred from the wax-containing coating layer on a surface of a substrate to an opposite surface of the substrate brought into contact with the wax-containing coating layer, and thus the opposite surface of the moisture-proof paper sheet becomes slippery. Accordingly, it becomes significantly difficult to keep the moisture-proof paper sheet having a very slippery surface in a desired form and at a location on a contacting face thereof. For example, when an article or material is packed with the wax-coated moisture-proof paper sheet, and portions of the wax-containing coating layer surface are brought into contact with each other, the portions of the packing sheet easily slip on each other at the contacting surface portions, and thus the packing paper sheet cannot keep the packing form or cannot stay at the desired location on the article or material. Therefore, the packing conditions of the article or material by the packing paper sheet become bad or ununiform, and the packing paper sheet may be easily slip off the article or material. Especially, when an article having a large weight is packed with the wax-coated paper sheet and the packed article is transported, the slippery surface may cause the packing paper sheet to slip at portions of the packing paper sheet which overlap each other, and the article or material is stripped of the package and falls from a transportation system, and packing paper sheet is broken. To solve the above-mentioned problems, there has been an attempt to form an anti-slip layer on a back surface of the packing paper sheet having the wax-containing coating layer located on the front surface thereof. However, the above-mentioned problems have not yet been fully solved.

Further, in the wax-coated moisture-proof paper sheets, an undesired bleeding of wax, which refers to a phenomenon of the wax moving from the inside to the surface of the wax-containing coating layer with the lapse of time, is inevitable. The wax-contaminated surface of the moisture resistant coating layer exhibits a significantly poor adhesive property, and an adhesive sheet or tape, for example, an adhesive label, cannot be firmly adhered or bonded to the wax-contaminated surface, and, even if adhered, is easily removed. Also, when the adhesive sheet or tape, for example, a label, is bonded to the wax-contaminated surface by a hot melt adhesive, only specific type of adhesives having a good property at room temperature can be used. Therefore, the usable hot melt adhesives are restricted to only special types thereof.

Furthermore, for packing with the wax-coated moisture-proof paper sheet, an adhesive paper tape, which can be re-pulped, can be utilized. However, the employment of the specific adhesive paper tape causes the adhering operation efficiency to be decreased in comparison with that using the usual adhesive or bonding agent, for example, a hot melt adhesive.

In another conventional moisture-proof paper sheet, a moisture resistant coating layer is formed from a synthetic resin latex, for example, a conventional SBR latex. This type of moisture-proof paper sheet is disadvantageous in that when moisture-proof paper sheets are placed under severe conditions for a long time, for example, when they are wound up into a plurality of rolls and the rolls are heaped up on each other into multi-layers and stored in this condition over a long time period, or when they are used to pack a plurality of articles or materials (for example, reams of printing paper sheets), and the resultant packages are heaped up on each other into multi-layers, and stored over a long time period, the front and back surfaces of the wound moisture-proof paper sheets, contacting with each other in the rolls are adhered to each other, or the inside surfaces of the moisture-proof paper sheets in the packages are adhered to the outer surfaces of the packed articles or materials (for example, reams of printing paper sheets), to generate a blocking phenomenon, which refers to a phenomenon in which a adhering property is generated on surfaces of articles brought into contact with each other at an elevated temperature under a presume, and the contacting surfaces of the articles are adhered to each other, and the blocking phenomenon is very difficult to eliminate. Especially, when the surfaces of the articles or materials to be packed are smooth, for example, the printing paper sheets to be packed are coated paper sheets having one or two smooth surfaces, the blocking phenomenon easily occurs.

It is known that to prevent the blocking phenomenon, a latex of a synthetic resin having a relatively high glass transition temperature (Tg, for example, of 40° C. or more) can be used as a synthetic resin latex for forming the moisture resistant coating layer. However, it is also known that the synthetic resin having a high glass transition temperature (Tg) causes the resultant moisture resistant coating layer to exhibit an increased stiffness and that the resultant moisture-proof paper sheet has an enhanced resistance to blocking, and when the resultant moisture-proof paper sheet is bent, the bent portion of the paper sheet exhibits a decreased moisture resistance.

Accordingly, there is a strong demand of moisture-proof paper sheets having both a high blocking resistance and a satisfactory moisture resistance.

SUMMARY OF THE INVENTION

An object of the present invention is to provide moisture-proof paper sheets which are capable of being repulped and recycled, after use, and have a proper surface smoothness, a high slip resistance and a high resistance to the blocking phenomenon.

Another object of the present invention is to provide moisture-proof paper sheets which are capable of being easily adhered to with adhesive sheets or tapes, for example, labels, and exhibit satisfactory printing and bonding properties in practice.

The above-mentioned objects can be attained by the moisture-proof paper sheets of the present invention, which comprises a paper sheet substrate and at least one moisture-proof coating layer formed on at least one surface of the paper sheet substrate, the moisture-proof coating layer comprising:

(a) a moisture-proof and film-forming synthetic resin;

(b) plate crystalline phyllosilicate compound particles having an average particle size of 5 to 50 μm and an aspect ratio of 5 or more; and (c) a moisture-proofness-enhancing agent.

DESCRIPTION OF THE PREFERRED EMBODIMENTS

The moisture-proof paper sheet of the present invention comprises a substrate comprising a paper sheet and at least one moisture-proof coating layer formed on at least one surface of the paper sheet substrate.

The moisture-proof coating layer comprises:

(a) a moisture-proof and film-forming synthetic resin;

(b) a plurality of plate crystalline phyllosilicate compound particles having an average particle size of 5 to 50 μm, preferably 10 to 40 μm and an aspect ratio of 5 or more, preferably 10 or more; and (c) a moisture-proofness-enhancing agent.

The moisture-proof and film-forming synthetic resin (a) usable for the present invention is not limited to a specific class of synthetic resin. However, the moisture-proof and film-forming synthetic resin (a) preferably comprises at least one polymer or copolymer selected from the following classes (a-1) and (a-2).

(a-1): Polymers and copolymers of at least one monomer selected from the group consisting of conjugated diene compounds having 4 to 6 carbon atoms, acrylic acid esters having 4 to 11 carbon atoms, methacrylic acid esters having 5 to 12 carbon atoms, ethylenically unsaturated nitrile compounds having 3 to 4 carbon atoms, ethylenically unsaturated carboxylic acid glycidyl esters having 6 or 7 carbon atoms and aromatic vinyl compounds having 8 to 11 carbon atoms.

(a-2): Copolymers of at least one hydrophobic comonomer selected from the group consisting of conjugated diene compounds having 4 to 6 carbon atoms, acrylic acid esters having 4 to 11 carbon atoms, methacrylic acid esters having 5 to 12 carbon atoms, ethylenically unsaturated nitrile compounds having 3 to 4 carbon atoms, ethylenically unsaturated carboxylic acid glycidyl esters having 5 to 6 carbon atoms, and aromatic vinyl compounds having 8 to 11 carbon atoms, with at least one hydrophilic comonomer selected from the group consisting of ethylenically unsaturated carboxylic acids having 3 to 7 carbon atoms and ethylenically unsaturated carboxylic acid amide having 3 to 9 carbon atoms.

In the moisture-proof paper sheets of the present invention, the conjugated diene compounds having 4 to 6 carbon atoms and usable as a monomer or comonomer for the polymers and copolymers of the classes (a-1) and (a-2), are preferably selected from butadienes, especially 1,3-butadiene, isoprene, and 2,3-dimethyl-1,3-butadiene, more preferably 1,3-butadiene and isoprene.

The acrylic acid esters having 4 to 11 carbon atoms usable for the polymers and copolymers of the classes (a-1) and (a-2) are preferably selected from methyl acrylate, ethyl acrylate, n-propyl acrylate, isopropyl acrylate, n-butyl acrylate, isobutyl acrylate, sec-butyl acrylate, n-pentyl (amyl) acrylate, isoamyl(pentyl) acrylate, n-hexyl acrylate, 2-ethylhexyl acrylate, n-heptyl acrylate, n-octyl acrylate, 2-hydroxyethyl acrylate, hydroxypropyl acrylate, and n-nonyl acrylate, more preferably from methyl acrylate and ethyl acrylate.

The methacrylic acid esters having 5 to 12 carbon atoms usable for the present invention are preferably selected from methyl methacrylate, ethyl methacrylate, n-propyl methacrylate, isopropyl methacrylate, n-butyl methacrylate, isopropyl methacrylate, sec-butyl methacrylate, n-pentyl (amyl) methacrylate, isoamyl(pentyl) methacrylate, n-hexyl methacrylate, 2-ethylhexyl methacrylate, n-heptyl methacrylate, n-octyl methacrylate, 2-hydroxyethyl methacrylate, hydroxypropyl methacrylate, and n-nonyl methacrylate, more preferably methyl methacrylate and ethyl methacrylate.

The ethylenically unsaturated nitrile compounds having 3 or 4 carbon atoms and usable for the present invention are preferably selected from acrylonitrile and methacrylonitrile, more preferably acrylonitrile.

The ethylenically unsaturated carboxylic acid glycidyl esters having 6 or 7 carbon atoms and usable for the present invention preferably include glycidyl acrylate and glycidyl methacrylate, more preferably glycidyl acrylate.

The aromatic vinyl compounds having 8 to 11 carbon atoms and usable for the present invention are preferably selected from styrene, α-methylstyrene, α-ethylstyrene, vinyl toluene, p-tert-butylstyrene and chlorostyrene, more preferably styrene.

The ethylenically unsaturated alcohol glycidyl ethers having 5 or 6 carbon atoms and usable for the present invention preferably include acrylglycidylether and methacrylglycidylether, more preferably acrylglycidylether.

In the moisture-proof paper sheets of the present invention, the ethylenically unsaturated carboxylic acids having 3 to 7 carbon atoms and usable as hydrophilic comonomers for the copolymers (a-2) to be contained in the moisture-proof and film-forming synthetic resin (a) are preferably selected from acrylic acid, methacrylic acid, crotonic acid, isocrotonic acid, vinylacetic acid, pentenic acids (angelic acid, tiglic acid), hexenic acids (2-hexenic acid, 3-hexenic acid), heptenic acids (2-heptenic acids), butenoic diacids (fumaric acid and maleic acid), and itaconic acid, more preferably acrylic acid and methacrylic acid.

The polymer or copolymers obtained from the above-mentioned carboxylic acid group-containing monomers, for example, a carboxylic acid-modified styrene-butadiene copolymer, are soluble slightly soluble in an aqueous alkali solution, namely an aqueous solution of a hydroxide of alkali metals, for example, sodium hydroxide or potassium hydroxide, and can be hydrophobilized or water-insolubilized by a salt-forming reaction with a basic compound having a hydrophobic moiety, for example an organic amine compound.

The ethylenically unsaturated carboxylic acid amides having 3 to 9 carbon atoms and usable as a hydrophilic comonomer for the present invention preferably include acrylic acid amide, methacrylic acid amide, vinylacetic acid amide, pentenic acid amides, mono- and di-amides of butenic diacids, mono and di-amides of itaconic acid, N-methylolacrylamide, N-methylolmethacrylamide, N-dimethylolacrylamide, N-dimethylolmethacrylamide, N-butoxymethylacrylamide and N-butoxymethylmethacrylamide, more preferably, acrylic acid amide and metacrylic acid amide.

In the copolymers (a-2) usable for the moisture-proof paper sheets of the present invention, there is no limitation on the copolymerization molar ratio of the hydrophobic comonomer to the hydrophilic comonomer. Preferably, the molar ratio of the hydrophobic comonomer to the hydrophilic comonomer is 95–60:5–40, more preferably 90 to 70:10 to 30. If the copolymerization molar ratio of the hydrophobic comonomer to the hydrophilic comonomer is less than 60/40, the resultant copolymer has too high a content of the hydrophibic comonomer, and thus may exhibit unsatisfactory moisture- and water-proofing properties. Also, if the molar ratio is higher than 95/5, the hydrophilic comonomer is contained in too low a content in the resultant copolymer and thus may not sufficiently contributes to improving the properties of the copolymer and to enhancing the effect of the moisture-proofness-enhancing agent used together with the copolymer.

The moisture-proof and film-forming synthetic resin (a) usable for the present invention mainly serves as a binder component for the moisture-proof coating layer and prevents the permination of moisture through the moisture-proof paper sheet. The moisture-proof and film-forming synthetic resin (a) is usually used in the state of an aqueous solution, an aqueous dispersion, or an aqueous emulsion. When the synthetic resin (a) is insoluble in water, it is preferably dispersed or emulsified in water with the aid of a dispersing agent or emulsifying agent. In this case, preferably the dispersing or emulsifying agent is used preferably in as small an amount as possible, and/or is selected from reactive surfactants. Also, in the polymerization procedure for the synthetic resin (a), the amount of the dispersing or emulsifying agent is preferably controlled to a level as low as possible and the particles size of the resultant synthetic resin (a) is adjusted preferable to a level as low as possible, for example, 150 nm or less. The synthetic resin (a) preferably has a glass transition temperature (Tg) of 5° to 30° C.

In the moisture-proof paper sheets of the present invention, the plate crystalline phyllosilicate compound particles (b) to be distributed in the moisture-proof coating layer have an average particle size of 5 to 50 μm, preferably 10 to 40 μm and an aspect ratio of 5 or more, preferably 10 or more. The phyllosilicate compound particles (b) are in the form of plate crystals having flat upper and lower surfaces thereof. Therefore, when a coating liquid containing the plate crystalline phyllosilicate compound particles (b) is applied to a surface of a paper sheet substrate, the plate crystalline particles are arranged in such a manner that the upper and lower flat surfaces of the particles become substantially parallel to each other and to the surface of the paper sheet substrate, and the parallel-arranged particles accumulate in a plurality of layers in the resultant coating layer. Therefore, since water molecules cannot permeate through the phyllosilicate compound particles, plate crystalline phyllosilicate compound particles are when moisture permeates through the coating layer, the water molecules must take a long way around the plate crystalline phyllosilicate compound particles. Due to the reasons that the permeating distance of the water molecules is too long, the permeating amount of the water molecules per unit time through the coating layer significantly decreases. Also, since the moisture-proof coating layer of the present invention exhibits a significantly decreased water vapor permeability, a moisture proofness of a moisture-proof coating layer formed from a synthetic resin latex and having a thickness of, for example, 200 μm can be fully attained by the moisture-proof coating layer of the present invention having a thickness of several tens μm.

In the moisture-proof paper sheets of the present invention, if the average size of the plate crystalline phyllosilicate compound particles is less than 5 μm, the parallel arrangement of the plate crystalline particles to each other and to the paper sheet substrate surface during coating operation becomes difficult, and thus the resultant moisture-proof coating layer cannot exhibit a satisfactory moisture-proofing effect. Also, if the average size is more than 50 μm, the plate crystalline particles are easily broken during a preparation of a coating liquid, and sometimes, end portions of the particles project from the surface of the coating layer. Also, the large size of the plate crystalline particles causes the number of the accumulated plate crystalline particle layers to decrease. Therefore, the resultant moisture-proof coating layer exhibits a decreased moisture-proofing effect.

In the moisture-proof paper sheets of the present invention, if the aspect ratio of the plate crystalline phyllosilicate compound particles is less than 5, it is difficult to arrange the plate crystalline particles in substantially in parallel to the surface of the paper sheet substrate, and thus the resultant moisture-proof coating layer exhibits an unsatisfactory moisture-proofing property. The number of the layers of the accumulated plate crystalline particles increases with an increase in the aspect ratio of the plate crystalline particles, and thus the moisture-proofness of the resultant coating layer increases with an increase in the number of the accumulated plate crystalline particle layers. The thickness of the plate crystalline particles varies in response to the type of the phyllosilicate compound, the type of method of pulverizing the plate crystalline particles and the average size of the plate crystalline particles. Generally, in the plate crystalline particles having an average particle size of 20 μm, the particle size is distributed in the range of from 2 to 60 μm, and thus the thickness of the crystalline particles is distributed in the range of from 0.1 to several μm. When the plate crystalline phyllosilicate compound particles are distributed in the moisture-proof coating layer of the present invention, if the particle size is excessively small in relation to the thickness of the coated layer, a proportion of a portion of the particles which is arranged substantially in parallel to the surface of the paper sheet substrate to the total amount of the particles contained in the coating layer coated on the substrate surface is small, and therefore, the necessary thickness of the moisture-proof coating layer for obtaining a desired moisture-proofing effect becomes larger. In this connection, to obtain as high a moisture-proofing effect as possible by a moisture-proof coating layer having a thickness as small as possible, preferably the plate crystalline phyllosilicate compound particles have an average particle size corresponding to 20% or more of the thickness of the coating layer on the substrate surface. Also, the largest length of the major axes of the plate crystalline phyllosilicate compound particles is preferably smaller than the thickness of the moisture-proof coating layer and more preferably corresponds to 100% or less of the moisture-proof coating layer. If the largest major axis of the plate crystalline particles is too large, portions of the particles may undesirably project from the surface of the moisture-proof coating layer or when the resultant moisture-proof paper sheet is bent or folded, a plurality of pores or voids are undesirably formed in the bent or folded portions, and therefore, the content of the plate crystalline particles having the large size in the moisture-proof coating layer must be reduced.

The plate crystalline phyllosilicate compound particles are in the form of fine plates or thin films and exhibit a distinct cleavage property. The plate crystalline phyllosilicate compound includes mica, pyrophyllite, talc, chlorite, septe greenstone, serpentine, stilpnomelane and clay minerals. Among the above-mentioned compounds, specific mineral compounds which can be obtained in a large particle size and in a large production amount from natural source, for example, mica group minerals and talc group mineral are preferably used for the present invention. The mica group minerals include muscovite, sericite, phlogopite, biotite, fluorophlogopite (artificial mica), lepidolite, paragonite, vanadium urea, illite, tin mica, paragolite and brittle mica. Also, delaminated kaolin, which is a species of kaolin, is included in the plate crystalline phyllosilicate compounds usable for the present invention. Among the above-mentioned plate crystalline phyllosilicate compounds, muscovite, sericite and talc are preferably employed for the present invention in consideration of particle size, aspect ratio and cost thereof. The chemical composition of muscovite is represented by a chemical formula: $K_2O.3Al_2O_3.6SiO_2.2H_2O$. To provide muscovite particles, muscovite rough stones are milled by a dry mill, for example, a hammer mill, screened to collect a fraction of the pulverized particles having particle sizes within a desired range thereof, and optionally, the collected fraction is further pulverized by a wet pulverizer, for example, a sand mill, in which the pulverization carried out in water with the aid of a pulverizing medium such as glass beads, to collect a fraction of the pulverized muscovite particles having a desired particle size distribution. In the above-mentioned milling and pulverizing procedures, to keep the aspect ratio of the particles within a desired range thereof, an application of a too large force to the particles must be avoided or the wet pulverizing operation must be carried out while applying ultrasonic to the particles, as disclosed in U.S. Pat. No. 3,240,203). By the application of the specific treatment, mica particles having a high aspect ratio can be obtained. Generally, the muscovite particles prepared by the above-mentioned process has an aspect ratio of 20 to 30, determined by an electron microscopic observation. Also, it is possible to produce the muscovite particles having an aspect ratio of about 100. However, the high aspect muscovite particles are difficult to produce industrially and are expensive, and thus they are difficult to be practically utilized.

The sericite has a chemical composition similar to that of the muscovite, except that the proportion of $SiO_2$ to $Al_2O_3$ is slightly higher and the content of $K_2O$ is lower than those of muscovite. However, the rough stones of sericite are smaller than muscovite rough stones, and thus the conventional sericite particles have an average particle size of about 0.5 to 2 μm. Almost all of the commercially available sericite particles have an average particle size falling within the above-mentioned range. They are not usable for the present invention. Therefore, the sericite particles for the present invention must be selected from those prepared by a specific method and having an average particle size of 5 to 50 μm. Namely, in the preparation of the sericite particles, the milling or pulverizing procedure must be carried out under a moderate or weak conditions, and a fraction of the milled or pulverized sericite particles having a desired particle size and aspect ratio must be collected by screening. Also, the sericite particles having the desired average particle size and aspect ratio may be collected from a residual fraction of the screening procedure for the conventional sericite particles. By the above-mentioned procedures, the specific sericite particles having the similar average size and aspect ratio to those of the muscovite particles can be obtained. Usually, the specific sericite particles have an aspect ratio of 10 to 30.

The talc has another name of agalmatolite or pyrophilite, consists essentially of a hydrate of magnesium silicate, and usually is in the form of fine foil-like particles. The usual commercially available talc particles for paper-making industry have an average particle size of 0.1 to 3 μm, and thus are not usable for the present invention.

The talc particles usable for the present invention are not available from the usual talc particles for the paper-making industry and thus must be specifically collected from special grade of talc particles for the ceramic industry, or produced by the same special milling or pulverizing and screening procedures as those of the sericite particles. The specifically collected or produced talc particles have an average particle size of about 10 μm and an aspect ratio of 5 to 10 which is smaller than that of the muscovite or sericite particles.

As mentioned above, the muscovite particles can be prepared from rough stones thereof having a significantly larger size than that of the sericite and talc, and the particle size distribution of the muscovite particles can be easily controlled by the milling or screening operations.

Also, the sericite particles have a high cleavage property and thus have a preferred plate-like form similar to that of the muscovite particles, whereas the rough stones of sericite have a small size. Also, talc particles are advantageous in having a low price thereof and thus are commonly used in practice, whereas the aspect ratio of talc particles is not so large.

In the moisture-proof coating layer of the present invention, the moisture-proof and film-forming synthetic resin (a) and the plate crystalline phyllosilicate compound particles (b) are employed preferably in a solid weight ratio (a)/(b) of 30/70 to 70/30, more preferably 40/60 to 60/40. If the proportion of the plate crystalline particles (b) based on the total solid weight of the synthetic resin (a) and the plate crystalline particles (b) is less than 30% by weight, the number of the accumulated layers of the plate crystalline particles may be too small and the distance between the plate crystalline particles may be too large, and thus the resultant moisture-proof coating layer may have an unsatisfactory moisture-proofness. In this case, therefore, the amount of the coating layer may have to increase, an economical disadvantage may occur, and the resultant coated paper sheets may exhibit a decreased resistance to the blocking phenomenon. Also, if the proportion of the plate crystalline particles is more than 7% by solid weight, a plurality of pores or voids may be formed between the plate crystalline particles (b) and the synthetic resin matrix (a), and thus the resultant coating layer may exhibit a decreased moisture-proofness.

In the moisture-proof paper sheet of the present invention, the moisture-proof coating layer thereof comprises a moisture-proofness-enhancing agent (c) together with the moisture-proof and film-forming synthetic resin (a) and the plate crystalline phyllosilicate compound particles (b). The moisture-proofness-enhancing agent (c) reacts with the moisture-proof and film-forming synthetic resin (a) so as to modify the resin (a) to a hydrophobic resin; or cross-links the moisture-proof and film-forming synthetic resin (a) so as to hydrophobilize the resin (a); or coats the plate crystalline phyllosilicate compound particles (b) therewith so as to enhance the bonding property of the particles (b) to the synthetic resin (a) or to improve the hydrophobicity of the plate crystalline particles (b); or promotes the parallel arrangement of the plate crystalline particles (b) to each other and to the substrate surface; or enhances the bonding property between the particles of the synthetic resin (a) and the particles of the plate crystalline phyllosilicate compound particles; or fills the gaps between the above-mentioned particles. Namely, the moisture-proofness-enhancing agent (b) is contributory to enhancing the moisture-proofing property of the moisture-proof coating layer.

The moisture-proofness-enhancing agent (c) preferably comprises at least one member selected from the group consisting of, for example, urea-formaldehyde condensation reaction products, melamine-formaldehyde condensation reaction products, aldehyde compounds having 1 to 8 carbon atoms, epoxy compounds having at least one epoxy group, cross-linkable multivalent metal compounds, organoalkoxysilane compounds, organoalkoxyl metal compounds, organic amine compounds, ammonia, polyamide compounds, polyamidepolyurea compounds, polyaminepolyurea compounds, polyamideaminepolyurea compounds, polyamideamine compounds, condensation reaction products of polyamideamine compounds with epihalohydrines or formaldehyde, condensation reaction products of polyamine compounds with epihalohydrines or formaldehyde, condensation reaction products of polyamidepolyurea compounds with epihalohydrines or formaldehyde, condensation reaction products of polyaminepolyurea compounds with epihalohydrines or formaldehyde, and condensation reaction products of polyamideaminepolyurea compounds with epihalohydrines or formaldehyde.

The urea-formaldehyde condensation reaction products and the melamine-formaldehyde condensation reaction products usable as the moisture-proofness-enhancing agent (c) of the present invention have methylol groups derived from formaldehyde. The methylol groups react with the polymers or copolymers in the synthetic resin component (a), especially with hydrophilic groups, for example, carboxyl groups, amide groups and hydroxyl groups, of the polymers or copolymers by a dehydration reaction, so as to cross-link the polymers or copolymers therethrough and to hydrophobilize the polymers or copolymers or to impart a three-dimensional network structure to the polymers or copolymers. Even when the condensation reaction products do not react with the synthetic resin (a), they can stably bond the synthetic resin (a) with the plate crystalline phyllosilicate compound particles (b), and enhance the moisture-proofing property of the resultant coating layer.

The aldehyde compounds having 1 to 8 carbon atoms and usable as the moisture-proofness-enhancing agent include formaldehyde, acetaldehyde, glyoxal, propylaldehyde, propane dial and hexanedial. These compounds can react, at the aldehyde group thereof, with the hydrophilic groups of the polymers or copolymers in the synthetic resin component (a), so as to hydrophobilize or water-insolubilize the polymers or copolymers.

The epoxy compounds having at least one epoxy group and usable as the moisture-proofness-enhancing agent (c), include polyglycidylether compounds and polyamide-epoxy resins. The epoxy groups of the epoxy compounds can react with the above-mentioned hydrophilic groups of the polymers or copolymers of the synthetic resin component (a) by a ring-opening, addition reaction, so as to hydrophobilize or water-insolubilize the polymers or copolymers. Also, the epoxy compounds can firmly bond the synthetic resin component (a) with the plate crystalline particle component (b) and fill the gaps between the components (a) and (b) during the drying procedure of the coated coating liquid, so as to enhance the moisture-proofing property of the resultant coating layer.

The cross-linkable multivalent metal compounds usable for the moisture-proofness-enhancing agent (c) include zirconium ammonium carbonate, zirconium alkoxides, titanium alkoxycides and aluminum alkoxydes.

The multivalent metal atoms in the compounds can react with the polymers or copolymers, especially with the hydrophilic groups, of the synthetic resin component (a) with covalent bonds or a coordination bonds, so as to hydrophobilize or water-insolubilize the polymers or copolymers.

In the moisture-proof paper sheets of the present invention, organoalkoxysilane compounds and organoalkyl metal compounds are usable as the moisture-proofness-enhancing agent (c). These organoalkoxysilane compounds and organoalkoxy metal compounds are generally referred to as coupling agents which serve, in an inorganic-organic material composite material system, to cross-bond the inorganic material component with the organic material component, or to chemically or physically react with both or either one of the inorganic and organic material components so as to enhance the affinity of the components to each other. Accordingly, the coupling agent is contributory to enhancing the heat resistance, water resistance and/or mechanical strength of the inorganic-organic composite material. In the present invention, the organoalkoxysilane compounds and the organoalkoxy metal compounds enhance the affinity and adhesion farce of the synthetic resin component (a) with the plate crystalline phyllosilicate compound particles (b) so as to intimately bond them to each other therethrough without forming gaps therebetween, and to improve the moisture-proofing property of the coating layer.

The organoalkoxysilane compounds usable for the present invention have silicon (Si) atoms located in the hydrophilic portions thereof, and include, for example, vinyltrimethoxysilane, γ-glycidoxypropylmethyldiethoxysilane, γ-glycidoxypropyltrimethoxysilane, γ-glycidoxypropyltriethoxysilane, γ-methacryloxypropyltrimethoxysilane, and N-β-(aminoethyl)-γ-aminopropyltrimethoxysilane.

The organoalkoxy metal compounds usable for the present invention contains multivalent metal atoms, for example, Ti or Al atoms, located in the hydrophilic portions thereof and include, for example, organic titanate compounds, for example, isopropyltriisostearoyl titanate, isopropyltrioctanoyl titanate, isopropylisostearoyldiacryl titanate, isopropyltricumylphenyl titanate, and isopropyltri-(N-aminoethyl.aminoethyl) titanate, and aluminum compounds, for example, acetoalkoxyaluminum diisopropylate.

The organoalkoxysilane compounds and organoalkoxy metal compounds (which will be referred to as coupling agents thereinafter), contain Si, Ti, or Al atoms located in the molecules thereof and have hydrophilic portions having a high reactivity or affinity to the inorganic substances and hydrophobic portions having a high reactivity or affinity to the organic compounds. The hydrophilic portions are formed by hydrolyizing alkoxyl groups bonded with Ti, Al or Si atoms.

It is believed that the reaction between the hydrophilic groups of the coupling agents and the inorganic compound proceeds in the following sequence.

(1) Formation of hydrophilic groups by hydrolysis of the alkoxyl groups of the coupling agents.

(2) Oligomerization of the coupling agent compound by dehydration condensation reaction thereof.

(3) Formation of hydrogen bonds between the hydrophilic groups or absorbed water located in the surface portion of the inorganic material and the hydrophilic groups of the coupling agent.

(4) Formation of covalent bonds between the hydrophilic groups of the coupling agents and the hydrophilic groups located in the inorganic material surface portion.

The alkoxyl groups capable of hydrolyzing include methoxyl groups, ethoxyl groups, isopropoxyl groups and octyloxy groups. The reactivity of the hydrophilic groups of the coupling agent with the inorganic compound is high when the inorganic compounds are glass, silica, alumina, talc, clay and mica, which have hydroxyl groups located in the surface portion thereof. When a titanate coupling agent is employed, this coupling agent exhibits a high reactivity even when the inorganic compounds are calcium carbonate, barium sulfate and calcium sulfate.

With respect to the hydrophobic portions of the coupling agent, when the hydrophobic portions are formed from an organic oligomer, the coupling agent can form a coating film of an organic polymer on the surface of the inorganic material so as to completely hydrophobilize the surface and to enhance the bonding property of the inorganic material surface with the organic material, namely, a synthetic resin matrix. Also, when the hydrophobic portions have reactive functional organic groups, for example, epoxy groups, vinyl groups and amino groups, the coupling agent can cross-link the reactive functional organic groups of the coupling agent with the reactive functional groups of the synthetic resin matrix, to enhance the bonding property of the inorganic material surface with the synthetic resin matrix. Accordingly, the constitution or composition of the hydrophobic portions of the coupling agent can be set forth in consideration of the composition and chemical constitution of the synthetic resin component.

The moisture-proof coating layer containing the coupling agent as the moisture-proofness enhancing agent can be formed by preparing a coating liquid by mixing the synthetic resin (a) and the plate crystalline phyllosilicate compound particles (b) with the coupling agent, coating a surface of the paper sheet substrate with the coating liquid, and drying the coating liquid layer on the substrate surface.

Alternatively, the plate crystalline phyllosilicate compound particles are surface treated with the coupling agent so that the coupling agent is fixed on the particle surfaces. Namely, the coupling agent can be applied by an integral blend method or a pre-treatment method. In the integral blend method, the coupling agent is directly mixed into a coating liquid comprising the synthetic resin (a) and the phyllosilicate compound particles (b). Also, in the pre-treatment method, the surfaces of the phyllosilicate compound particles are pre-treated with the coupling agent. This pre-treatment method can be carried out in a dry system or a wet system. In the dry pre-treatment method, phyllosilicate compound particles in the state of a powder are placed in a mixer and pre-heated in the mixer, then the coupling agent is mixed with the particles and the mixture is agitated at an elevated temperature at a high agitating speed. In the wet pre-treatment method, the phyllosilicate compound particles are dispersed in water or an organic solvent, or a mixture of water and the solvent, and the dispersion is agitated at a high speed and then dried. The integral blend method is superior in process efficiency because no pre-treatment of the phyllosilicate compound particles is necessary, whereas in this method, the utilization efficiency of the coupling agent is slightly lower than in the pre-treatment method.

When the phyllosilicate compound particles are treated in an aqueous system in the integral blend method or the pre-treatment method, to promote the dissolution of the coupling agent in the aqueous system, the alkoxyl groups of the coupling agent are preferably selected from methoxyl, ethoxyl, and isopropoxyl groups which have a relatively weak hydrobobicity, and the hydrophobic portions of the coupling agent preferably comprise at least one selected from epoxy, amino and hydroxyl groups which are hydrophilic. In the case where the coupling agent is difficult to dissolve in water, a very small amount of a surfactant may be used together with the coupling agent.

The coupling agent is used preferably in an amount of 0.1 to 5 parts by weight, more preferably 0.5 to 2 parts by weight, per 100 parts by weight of the plate crystalline phyllosilicate compound particles. If the coupling agent is used in an amount less than 0.1 parts by weight, the surfaces of the plate crystalline particles may be insufficiently coated by the coupling agent, and thus the moisture-proofing effect of the coupling agent may be insufficient. Also, if the amount of the coupling agent is more than 5 parts by weight, the moisture-proofing effect of the resultant coating layer may be saturated and thus an economical disadvantage may occur.

In the case where the surfaces of the phyllosilicate compound particles treated with the coupling agent exhibit too high a hydrophobicity, and thus when dispersed in water, the resultant aqueous dispersion of the surface-treated particles exhibit such a high viscosity that the aqueous dispersion cannot be used for coating, or the surface-treated particles aggregate to form a mass, the surface-treated particles can be smoothly dispersed in water with the aid of a surfactant, a dispersing agent, for example, polyacrylic acid compound, or a wetting agent, for example, isopropyl alcohol or sodium dialkylsulfosuccinate.

In the moisture-proof paper sheet of the present invention, the organic amine compounds and polyamide compounds usable as the moisture-proofness-enhancing agent has a cationic property and thus when brought into contact with the plate crystalline phyllosilicate compound particles (b) which are anionic, the organic amine compounds and the polyamide compounds promote a soft agglomaration, parallel-arrangement and accumulation of the plate crystalline particles, and thus the resultant moisture-proof coating layer exhibits an enhanced moisture-proofing property. Since the organic amine compounds and the polyamide compounds do not cross-link the synthetic resin (a) or cross-link the synthetic resin with ionic bonds, the resultant moisture-proof coating layer formed by using them can be easily separated from the paper sheet substrate when the moisture-proof paper sheets are brought into contact with water in a re-pulping procedure, and thus the paper sheet substrate can be smoothly re-pulped.

In the case where the copolymers contained in the synthetic resin component (a) have carboxylic acid groups, organic monoamine compounds, organic polyamine compound or organic quaternary ammonium salt compounds can react with the carboxylic acid groups and enhance the hydrophobicity or water-insolubility of the synthetic resin component (a).

The organic amine compounds usable as the moisture-proofness-enhancing agent of the present invention include primary amine compounds, secondary amine compounds, tertiary amine compound and quaternary ammonium salt compounds, and may be either of organic monoamine compounds and organic polyamine compounds. Also, the organic amine compounds usable for the present invention may have additional functional groups different from the amino groups, for example, epoxy groups, hydroxyl groups, carboxylic acid groups and nitrile groups. The organic amine compounds modified by the additional functional groups include addition reaction products of epoxy group-containing compounds such as mono-epoxy compounds or diepoxy compounds with amine compounds, addition reaction products of compounds having hydroxyl groups, for example, ethyleneoxide and propyleneoxide with amine compounds, Mihael addition reaction products of acrylonitrile with amine compounds and Mannich reaction products of phenol compounds with aldehyde compounds and amine compounds.

The above-mentioned modification of the amine compounds has the following advantageous effects.

(1) The stimulant odor or toxicity, for example, skin-stimulation property, of the amine compounds is reduced.

(2) The viscosity of the amine compounds is reduced.

(3) The molecular weight of the compound is increased and thus errors in weighing are reduced.

With respect to the degree of modification of the amine compounds, there is no specific limitation.

The organic amine compounds usable for the present invention include the following compounds.

1) Aliphatic polyamines (polyalkylenepolyamines) or monoamines ethylenediamine, propylenediamine, diethylenetriamine, triethylenetetramine, tetraethylenepentamine, pentaethylenehexamine, imino-bis-propylamine, bis (hexamethylene)triamine, dimethylaminopropylamine, diethylaminopropylamine, aminoethylethanolamine, methyliminobispropylamine, menthandiamine-3, N-aminoethylpiperazine, 1,3-diaminocyclohexane, isophoronediamine, triethylenediamine, polyvinylamine, stearylamine and laurylamine.

2) Aromatic polyamines or monoamines m-phenylenediamine, 4,4'-methylenedianiline, benzidine, diaminodiphenylether, 4,4'-thiodianiline, dianisidine, 2,4-toluenediamine, diaminodiphenylsulfon, 4,4'-(o-toluidine), o-phenylenediamine, methylene-bis(o-chloroaniline), m-aminobenzylamine and aniline.

3) Aliphatic polyamines or monoamines having aromatic cyclic group metaxylylenediamine, tetrachloroxylylenediamine, trimethylaminomethylphenol, benzyldimethylamine, and α-methylbenzyldimethylamine.

4) Secondary amines

N-methylpiperazine, piperidine, hydroxyethylpiperazine, pyrrolidine, and morpholine.

5) Tertiary amines tetramethylguanidine, triethanolamine, N,N'-dimethylpiperazine, N-methylmorpholine, hexamethylenetetramine, triethylenediamine, 1-hydroxyethyl-2-heptadecylglyoxazine, pyridine, pyrazine, and quinoline.

6) Quaternary ammonium salt compounds diallyldimethyl ammonium chloride, hexyltrimethyl ammonium chloride, cyclohexyltrimethyl ammonium chloride, octyltrimethyl ammonium bromide, 2-ethylhexyltrimethyl ammonium bromide, 1,3-bis (trimethylammoniomethyl)cyclohexane dichloride, lauryldimethylbenzyl ammonium chloride, stearyldimethylbenzyl ammonium chloride, and tetradecyldimethylbenzyl ammonium chloride.

7) Betaine compounds, glycine compounds and amino acid compounds

Coconut oil alkyl betaine, betaine lauryldimethylaminoacetate, amidopropylbetaine laurate, polyoctylpolyaminoethyl glycine, and sodium laurylaminopropionate.

Among the above-mentioned organic amine compounds, the aliphatic polyamine compounds, the aliphatic polyamine compounds having aromatic cyclic groups and the modified polyamine compounds are preferably used for the present invention.

The polyamide compounds, which include polyamideamine compounds, usable for the present invention are produced by a dehydration condensation reaction of amine compounds, for example, those as mentioned above, with organic compounds having one or more carboxylic acid groups.

For example, the polyamide compounds include reaction products of tall oil with diethyltriamine, reaction products of dimer of linolenic acid with tetraethylpentamine, reaction products of triethylenetetramine with saturated dibasic carboxylic acids, for example, adipic acid, sebacic acid, isophthalic acid and terephthalic acid, and reaction products of polymerized fatty acids with diethyltriamine. The polyamide compounds preferably have a molecular weight of about 1000 to 5000.

The organic amine compounds and the polyamide compounds usable for the present invention are preferably soluble in water. Even if they are insoluble in water, they can be utilized by emulsifying or dispersing them in water. The above-mentioned amine compounds and polyamide compounds may be used alone or in a mixture of two or more thereof. The organic amine compounds and the polyamide compounds preferably have an amine value of 100 to 1000. However, there is no limitation to the amme value of them.

The epoxy compound usable as a moisture-proofness-enhancing agent for the present invention may be selected from monoepoxy compounds which include aliphatic monoepoxy compounds and aromatic monoepoxy compounds. The monoepoxy compounds are preferably selected from butyleneoxide, octyleneoxide, butylglycidylether, styreneoxide, phenylglycidylether, glycidyl methacrylate, allylglycidylether, phenolpolyethyleneglycolglycidylether, and laurylalcohol polyethyleneglycolglycidylether.

The monoepoxy compounds usable for the present invention are preferably soluble in water. However, water-insoluble monoepoxy compounds can be utilized for the present invention by dispersing the compound in water with the aid of a surfactant in an amount of 0.1 to 3% by weight based on the weight of the monoepoxy compounds.

The above-mentioned monoepoxy compounds are used preferably in an amount of 0.05 to 10 parts by weight, more preferably 0.5 to 5 parts by weight per 100 parts by weight of the synthetic resin component (a).

If the amount of the monoepoxy compounds is less than 0.05 parts by weight, the resultant moisture-proof coating layer may exhibit an unsatisfactory moisture-proofing property. Also, if the amount of the monoepoxy compounds is more than 10 parts by weight, the moisture-proofing effect thereof may saturate and thus an economical disadvantage may occur.

When a moisture-proofness-enhancing agent containing the monoepoxy compounds is employed, the synthetic resin (a) preferably comprises a copolymer produced from a monomer having a hydrophilic functional group which is reactive with the epoxy ring of the monoepoxy compounds, for example, carboxyl group, amide group or hydroxyl group. The hydrophilic monomer is preferably selected from, for example, acrylic acid, acrylamide, acrylonitrile and methyl methacrylate.

The polyamidepolyurea compounds, the polyaminepolyurea compounds, the polyamideaminepolyurea compounds and the polyamideamine compounds usable as a moisture-proofness-enhancing agent for the present invention can be synthesized by reacting (i) polyalkylenepolyamine or alkylenepolyamine compounds with (ii) urea compounds, (iii) dibasic carboxylic acids and optionally (iv) a compound selected from aldehyde compounds, epihalohydrin compounds and α,γ-dihalo-β-hydrin compound, by the process as disclosed in Japanese Examined Patent Publication No. 59-32,597 or Japanese Unexamined Patent Publication No. 4-10,097. In the above-mentioned synthetic process, when the dibasic carboxylic acids (iii) are used, the polyamidepolyurea compounds or the polyamideaminepolyurea compounds are obtained, and when the dibasic carboxylic acids (iii) are not employed, the polyaminepolyurea compounds are obtained.

When the aldehyde or epihalohydrine compounds are employed, it is preferable that these compounds are used in a very small proportion or are self-cross-linked during the synthesis procedure so that substantially no methylol or epoxy groups are retained in the resultant product.

Also, in the above-mentioned synthetic process, when the urea compounds (ii) are not employed, and the polyalkylenepolyamine or alkylene polyamine compounds (i) are reacted with the dibasic carboxylic acids (iii), the polyamideamine compounds are obtained. The compounds (iv), namely, the aldehyde compounds, the epihalohydrin compounds or α,γ-dihalo-β-hydrin compounds, are employed in an amount of 5 to 300 moles per 100 moles of the component (i). The polyalkylenepolyamine or alkylenepolyamine compounds usable as a component (i) for the synthesis are selected from, for example, diethylenetriamine, triethylenetetramine, tetraethylenepentamine, iminobispropylamine, 3-azahexane-1,6-diamine, 4,7-diazadecane-1,10-diamine, ethylenediamine, propyldiamine, 1,3-propanediamine and hexamethylenediamine. Among the above-mentioned compounds, diethylenetriamine and/or triethylenetetramine is preferably employed. The compounds (i) may be used alone or in a mixture of two or more thereof. The compounds (i) may be used together with at least one compounds selected from cycloaliphatic amine, for example, cyclohexylamine, and cycloaliphatic epoxy compounds.

The urea compounds usable as a component (ii) for the synthesis, include urea, thiourea, guanylurea, methylurea and dimethylurea. Among them, urea is preferably used. The urea compounds (ii) may be employed alone or in a mixture of two or more thereof.

The dibasic carboxylic acids usable as a component (iii) for the synthesis have two carboxyl groups or derivative groups thereof per molecule of the compounds, and may be in the form of a free acid an ester or an acid anhydride. The dibasic carboxylic acids may be selected from aliphatic, aromatic and cycloaliphatic dibasic carboxylic acids. Preferably, the dibasic carboxylic acids are selected from succinic acid, glutaric acid, adipic acid, sebacic acid, maleic acid, fumaric acid, phthalic acid, isophthalic acid, terephthalic acid tetrahydrophthalic acid and hexahydrophthalic acid. Also, the dibasic carboxylic acids include polyester compounds which are reaction products of dibasic carboxylic acids with glycol compounds and have free terminal carboxylic acid groups. These dibasic carboxylic acids may be used alone or in a mixture of two or more thereof.

The aldehyde compounds usable as a component (iv) for the synthesis, include alkylaldehyde compounds, for example, fromaldehyde and propylaldehyde, glyoxal, propanedial and butanedial.

The epihalohydrin compounds usable as a component (iv) for the synthesis include epichlorohydrin and epibromohydrin.

The α,γ-dihalo-β-hydrin compounds usable as a component (iv) for the synthesis include 1,3-dichloro-2-propanol.

The aldehyde, epihalohydrin and α,γ-dihalo-β-hydrin compounds may be used alone or in a mixture of two or more thereof. In the synthesis of the polyamidepolyurea, polyaminepolyurea, polyamideaminepolyurea and polyamideamine compounds, the above-mentioned reaction products may be further reacted with at least one compounds selected from cycloaliphatic epoxy compounds, alkylating agents (of the general formula: R—X wherein R represents a member selected from lower alkyl groups, alkenyl groups, benzyl group, and phenoxyethyl group and X represents a halogen atom), and compounds of the general formula: R'—C(=Y)—$NH_2$ wherein R' represents an alkyl group or —$NR'_2$ group, Y represents an oxygen or sulfur atom.

The above-mentioned components of the synthesis may be reacted at a desired sequence. As an example of the synthesis, the following process can be utilized. Namely, an alkylenediamine or polyalkylenepolyamine are reacted with a urea compound by a deammoniation reaction, the resultant reaction product is reacted with a dibasic carboxylic acid by a dehydration condensation reaction, and then the resultant reaction product is reacted with a urea compound by a deammoniation reaction, to provide a polyamidepolyurea compound. The polyamidepolyurea compound can be converted to a polyamidepolyurea-aldehyde or epihalohydrin urea by reacting with an aldehyde, epihalohydrin or α,γ-dihalo-β-hydrin compound.

The aldehyde, epihalohydrin and α,γ-dihalo-β-hydrin compounds are used for the purpose of regulating the molecular weight and the water-solubility of the product compounds. However, they are used preferably to such an extent that the resultant methylol group or epoxy groups are self-cross-linked and substantially no methylol and epoxy group remains in the final product. The polyamidepolyamine compounds, the polyaminepolyurea compounds, the polyamideaminepolyurea compounds and the polyamideamine compounds usable as a moisture-proofness-enhancing agent for the present invention exhibit a weak cationic property in an aqueous coating liquid, and thus, during the coating layer-forming procedure, cause the plate crystalline phyllosilicate compound particles, which are anionic, to soft-aggregate and to be arranged and accumulated in parallel to each other and to the substrate surface. The enhancement in the parallel arrangement of the plate crystalline particles effectively contributes to enhancing the moisture-proofing property of the resultant coating layer.

As mentioned above, the compounds may includes those having epoxy groups and/or methylol groups. However, the content of the epoxy and/or methylol groups in the compounds is very small and almost all of them self-crosslink. Therefore, the influence of the methylol and epoxy groups is negligible. Accordingly, in the resultant moisture-proof paper sheet having a moisture-proof coating layer containing the above-mentioned weakly cationic compounds, the moisture-proof coating layer can be easily separated from the paper sheet substrate in an aqueous treatment system for recovering waste paper sheets, and the paper sheet substrate can be easily re-pulped without difficulty. Namely, no difficulty in re-pulping of the paper sheet substrate is recognized.

In the present invention, polyamideamine-epihalohydrin or formaldehyde condensation reaction products, polyamine-epihalohydrin or formaldehyde condensation reaction products, polyamidepolyurea-epihalohydrin or formaldehyde condensation reaction products, polyaminepolyurea-epihalohydrin or formaldehyde condensation reaction products, and polyamideaminepolyurea-epihalohydrin or formaldehyde condensation reaction products can be used as a moisture-proofness-enhancing agent (c) for the present invention.

The above-mentioned condensation reaction products contain amino groups contained in the backbone chains of the molecules thereof and further contain methylol groups or epoxy groups contained in the side chains of the molecules. They can be synthesized from the following components:

(i) polyalkylenepolyamine compounds.

(ii) urea compounds.

(iii) dibasic carboxylic acid compounds. and (iv) epihalohydrin or formaldehyde, in accordance with the processes as disclosed in Japanese Examined Patent Publication Nos. 52-22,982, 60-31,948 and 61-39,435 and Japanese Unexamined Patent Publication No. 55-127,423. By reacting the component (i) with the components (ii) to (iv), the polyamidepolyurea-epihalohydrin or formaldehyde condensation reaction products or the polyamideaminepolyurea-epihalohydrin or formaldehyde condensation reaction products are obtained. When the component (i) is reacted with the components (ii), (iii) and (iv), the polyaminepolyurea-epihalohydrin or formaldehyde condensation reaction products are obtained. When the component (i) is reacted with the components (iii) and (iv), the polyamideamine-epihalohydrin or formaldehyde condensation reaction products are obtained. Further, when the component (i) is reacted with the component (iv), the polyamine-epihalohydrin or formaldehyde condensation reaction products can be obtained.

The polyalkylenepolyamine compounds usable as a component (i) for the synthesis are selected from, for example, diethylenetriamine, triethylenetetramine, tetraethylenepentamine, iminobispropylamine, 3-azahexane-1,6-diamine, 4,7-diazadecane-1,10-diamine, ethylenediamine, propyldiamine, 1,3-propanediamine, hexamethylenediamine, bis(3-aminopropyl)methylamine, bishexamethylenetriamine and polymers of diallylamine compounds, for example, poly(N-methyldiallylamine-hydrochloric acid salt) and polyvinylbenzylamine-dimethylamine-hydrochloric acid salt, and dicyandiamine. Among the above-mentioned compounds, diethylenetriamine, triethylenetetramine and diallylamine compound polymers are preferably employed. The compounds (i) may be used alone or in a mixture of two or more thereof.

The urea compounds usable as a component (ii) for the synthesis, include urea, thiourea, guanylurea, methylurea and dimethylurea. Among them, urea is preferably used. The urea compounds (ii) may be employed alone or in a mixture of two or more thereof.

The dibasic carboxylic acids usable as a component (iii) for the synthesis have two carboxyl groups or derivative groups thereof per molecule of the compounds, and may be in the form of a free acid, an ester or an acid anhydride. The dibasic carboxylic acids may be selected from aliphatic, aromatic and cycloaliphatic dibasic carboxylic acids. Preferably, the dibasic carboxylic acids are selected from succinic acid, glutaric acid, adipic acid, sebacic acid, maleic acid, fumaric acid, phthalic acid, isophthalic acid, terephthalic acid tetrahydrophthalic acid and hexahydrophthalic acid. Also, the dibasic carboxylic acids include polyester compounds which are reaction products of dibasic carboxylic acids with glycol compounds and have free terminal carboxylic acid groups. These dibasic carboxylic acids may be used alone or in a mixture of two or more thereof.

The epihalohydrin compounds usable as a component (iv) for the synthesis include epichlorohydrin, epibromohydim, and α,γ-dihalo-β-hydrin compounds for example, 1,3-dichloro-2-propanol.

The formaldehyde and epihalohydrins may be used alone or in a mixture of two or more thereof.

The component (iv) is prepared preferably in an amount of 5 to 300 molar parts per 100 molar parts of the polyalkylenepolyamine component (i).

As an example of the synthesis, the following process can be utilized for the synthesis of the polyamide-epihalohydrin reaction products.

Diethylenetriamine is placed in an amount of 0.97 mole in a reaction vessel, one mole of adipic acid is gradually placed in the reaction vessel, while stirring the reaction mixture. The reaction mixture is heated at a temperature of 170° C. for 1.5 hours. The resultant viscous liquid is cooled to a temperature of 140° C., and then to the cooled liquid, water is added in an amount sufficient to adjust the solid concentration of the resultant solution to 50% by weight, to prepare a polyamide solution. To the polyamide solution, water is added in an amount sufficient to adjust the solid concentration of the resultant solution to 13.5% by weight. The resultant solution is heated to a temperature of 40° C. The heated solution is gradually added with epichlorohydrin in an amount corresponding to 1.3 moles per mole of secondary amine contained in the polyamide. The reaction mixture is heated at a temperature of 60° C. until the viscosity of the reaction mixture reaches a Gardner viscosity of E to F. To the reaction product, water is added in an amount sufficient for adjusting the solid concentration of the resultant solution to 12.5% by weight, and the solution is cooled to a temperature of 25° C. A polyamide-epihalohydrin compound is obtained.

Other condensation reaction products can be obtained by the similar method to the above-mentioned method.

The polyamideamine-epihalohydrin or formaldehyde condensation reaction products, the polyamine-epihalohydrin or formaldehyde condensation reaction products, polyamidepolyurea-epihalohydrin or formaldehyde condensation reaction products, polyaminepolyurea-epihalohydrin or formaldehyde condensation reaction products, and polyamideaminepolyurea-epihalohydrin or formaldehyde condensation reaction products usable as a moisture-proofness-enhancing agent for the present invention exhibit good solubility in water in the aqueous coating liquid. Nevertheless, the moisture-proof coating layer formed from the aqueous coating layer exhibits an enhanced moisture-proofing performance. Also, the moisture-proof coating layer fixed on a substrate surface can be easily detached from the substrate in an aqueous re-pulping system, and thus the paper sheet substrate can be smoothly re-pulped without any difficulty. Accordingly, it is believed that the above-mentioned condensation reaction products substantially do not cross-link the synthetic resin component (a) in the coating layer.

The above-mentioned condensation reaction products exhibit a weak cationic property in an aqueous solution thereof. Therefore, during the formation of the moisture-proof coating layer, the condensation reaction products aggregate the anionic plate crystalline phyllosilicate compound particles (b) into soft agglomerates and promote the arrangement and accumulation of the plate crystalline particles (b) in parallel with each other and to the substrate surface, so as to enhance the moisture-proofing property of the coating layer.

In an embodiment of the moisture-proofness-enhancing agent (c), a cross-linking agent is used together with a coupling agent. In this case, the cross-linking agent comprises at least one member selected from the above-mentioned urea-formaldehyde condensation reaction products, melamine-formaldehyde condensation reaction products, aldehyde compound having 1 to 8 carbon atoms, epoxy compounds having at least one epoxy group, cross-linking multivalent metal compounds, organic amine compounds and polyamide compounds. Also the coupling agent comprises at least one member selected from the above-mentioned organoalkoxysilane compounds and organoalkoxy metal compounds.

Also, in this case, the polymers or copolymers contained in the synthetic resin component (a) preferably contain hydrophilic functional groups, for example, carboxyl group, amide group and hydroxyl group. Also, the acid modification percent of the polymers or copolymers is preferably 5 molar % or more.

In the moisture proofness enhancing agent (c) of this embodiment, the cross-linking agent is preferably used in an amount of 0.05 to 10 parts by weight per 100 parts by weight of the synthetic resin (a), and the coupling agent is employed preferably in an amount of 0.1 to 5 parts by weight per 100 parts by weight of the plate crystalline phyllosilicate compound particle (b).

In the moisture-proof paper sheet of the present invention, the moisture-proofness-enhancing agent is preferably contained in an amount of 0.05 to 10 parts by weight, more preferably 0.5 to 5 parts by weight, per 100 parts by weight of the synthetic resin component (a). If the amount of the moisture-proofness-enhancing agent (c) is less than 0.05 parts by weight, the resultant coating layer may exhibit an unsatisfactory moisture-proofing property. Also, if the amount of the moisture-proofness-enhancing agent (c) is more than 10 parts by weight, the moisture-proofness of the resultant coating layer may saturate and thus an economical disadvantage may occur.

When the moisture-proofness-enhancing agent is strongly cationic, and thus causes the synthetic resin (a) to be coagulated, the pH of the aqueous solution of the cationic moisture-proofness-enhancing agent should be regulated to about 8 before mixing it with the synthetic resin (a).

The paper sheet substrate usable for the present invention comprises, as a principal component, pulp fibers which can be easily dispersed in water by a mechanical disintegration procedure. The easily dispersible pulp includes chemical pulps, for example, hard wood kraft pulps and soft wood kraft pulps and mechanical pulps. The paper sheet substrate may be provided from woodfree paper sheets, fine paper sheets, one surface-glazed kraft paper sheets, both surface-roughed kraft paper sheets and stretchable kraft paper sheets. There is no limitation to the basis weight of the substrate. Usually, the paper sheet substrate preferably has a basis weight of 30 to 300 g/m$^2$. The type and basis weight of the paper sheets for the substrate are established in consideration of the use of the target moisture-proof paper sheets.

To prepare the moisture-proof paper sheet of the present invention, an aqueous coating liquid is prepared from the desired components, and coated on one surface or two surfaces of a paper sheet substrate; the coating liquid layer formed on the substrate is dried, to form a moisture-proof coating layer. There is no limitation to the types of coating method and apparatus.

For example, a conventional air knife coater, a bar coater, a roll coater, a blade coater on a gate roll coater can be used for the coating procedure. The drying method and apparatus for the present invention are not limited to specific method and apparatus. For example, a hot air dryer, a contact-heating plate, a contact-heating roll dryer, an infrared ray dryer or a high frequency dryer can be used for the present invention. The drying temperature may be established preferably in the range of from 70° C. to 170° C., more preferably from 100° C. to 150° C., in consideration of the types of and contents the components of the target moisture-proof coating layer and the type of the dryer.

EXAMPLES

The present invention will be further explained by the following examples which are merely representative and do not intend to restrict the scope of the present invention in any way.

In the examples, the term "part by weight" refers to "part by weight of solid content".

Also, in the examples, the resultant moisture-proof paper sheet was subjected to the following tests.

(1) Water vapor permeability

In accordance with Japanese Industrial Standard (JIS) Z0208, Cup method, B-method, a specimen of a moisture-proof paper sheet was placed on a tester so that the moisture-proof coating layer surface thereof faces outside of the tester, and the moisture permeability of the specimen was measured.

Usually, paper sheets having a water vapor permeability of 50 g/m$^2$·24 hr or less are practically usable as moisture-proof paper sheets. The practical moisture-proof paper sheets preferably have a water vapor permeability of 35 g/m$^2$·24 hr or less.

(2) Moisture permeability of synthetic resin component (a)

A coating liquid comprising a synthetic resin to be tested was coated on an unbleached, two surface-roughed kraft paper sheet having a basis weight of 70 g/m$^2$ to form a dry coating layer in an amount of 20 g/m$^2$ and the coating liquid layer was dried at a temperature of 110° C. for 2 minutes. A synthetic resin-coated paper sheet was obtained. A specimen of the synthetic resin-coated paper sheet was subjected to the above-mentioned water vapor permeability test, in accordance with JIS Z0208, Cup method, B-method, in which the sample was placed on the tester in such a manner that the synthetic resin-coated surface of the specimen comes outside of the tester.

(3) Friction coefficient

Two specimens of moisture-proof paper sheet were superposed on each other in such a manner that a moisture-proof coating layer surface of one specimen comes into contact with a back surface of the other specimen. The superposed specimens were passed once through a supercalender under a linear pressure of 12 kg/cm. The kinetic friction coefficient between the back surfaces of the two specimens was measured in accordance with JIS P8147, at a measurement speed of 150 mm/min.

(4) Blocking resistance

A moisture-proof paper sheet was cut into a specimen having dimensions of 20 cm×20 cm. On the moisture-proof coating layer of the specimen, a A2 coat paper sheet was superposed. The resultant laminate was pressed at a temperature of 40° C. under a pressure of 12 kg/cm$^2$ for 30 minutes, to adhere the cut piece to the coat paper sheet.

The bonding strength between the specimen and the coat paper sheet was observed and evaluated as follows.

| Class | Observation | Evaluation |
|---|---|---|
| 3 | They can be easily separated from each other. | Good |
| 2 | They can be separated from each other, while generating a peeling noise. | Bad |
| 1 | They were broken before separation. | Very bad |

(5) Capability of being re-pulped and re-used

Test method-1

A moisture-proof paper sheet was cut into pieces having dimensions of 1 cm×1 cm. The pieces in an amount of 8 g were mixed in a concentration of 1.6% by weight in 500 ml of water, and agitated in a home mixer for 2 minutes to prepare a regenerated pulp slurry. The pulp slurry was removed from the mixer and subjected to a paper-forming procedure by using a laboratory paper-forming machine, to make paper sheets. The resultant paper sheets were dried on a cylinder dryer at a temperature of 120° C.

The resultant paper sheet was checked for non-disintegrated fractions (for example, film pieces, fiber mass or non-repulped paper pieces) contained in the resultant paper sheet, by the naked eye. When the resultant paper sheet contained no non-disintegrated piece and had a uniform appearance, the re-pulping property of the moisture-proof paper sheet was evaluated good.

Test method-2

A moisture-proof paper sheet to be tested was conditioned at a temperature of 40° C. for one week, which conditioning condition corresponds to a conditioning at room temperature for 2 to 3 months. The conditioned moisture-proof paper sheet in an amount of 450 g was cut into size A4 sheets, and mixed in a concentration of 3% by weight into 15 kg of water.

The mixture was agitated in a Cowless disperser at a rotation speed of 1500 rpm for 20 minutes. The resultant aqueous slurry was subjected to a paper-forming procedure using a laboratory paper-forming machine. The resultant paper sheets were dried at a temperature of 120° C. on a cylinder dryer. The resultant paper sheets were checked for non-disintegrated pieces (for example, filmy pieces, paper pieces) contained therein by the naked eye, to evaluate the re-pulping property of the moisture-proof paper sheet. When no disintegrated piece was contained and the appearance was uniform, the re-pulping property of the resultant moisture-proof paper sheet was evaluated to be good.

(6) Average particle size

An average particle size of pigment particles dispersed in water was measured by a laser diffraction particle size distribution tester (trademark Simazu Tester SALD-1100, V2.0, made by Simazu Seisakusho), under the following conditions. The average particle size refers to a size of particles at an integrated volume fraction of 50%.

Measurement conditions

Range of particle size for measurement: 1 to 150 μm or 0.1 to 45 μm

Refraction index: 1.6

Calculation: Direct calculation method

Measurement number: Four times

Measurement time intervals: 2 seconds

Example 1

A moisture-proof coating liquid was prepared by mixing 50 parts by weight of a moscovite pigment (plate crystalline phyllosilicate compound particles (b), trademark: Mica A21, made from Yamaguchi Unmokogyosho) having an average particle size of 20 μm and an aspect ratio of 20 to 30 with 48 parts by weight of a carboxylic acid-modified SBR latex (synthetic resin (a), trademark: SBR LX407S1X1, made by Nihon Zeon K.K.) having an acid modification of about 20%, a Tg of 18° C. and a solid content of 48% by weight and 2 parts by weight of sorbitolpolyglycidylether (moisture-proofness-enhancing agent (c), trademark: Deconal EX614B, made by Nagase Kasei K.K.) having a solid content of 98% or more.

The coating liquid was coated on a surface of an unbleached, two surface-roughed kraft paper sheet by using a mayer bar, to form a dry coating layer in an amount of 30 g/m$^2$, and then dried in a hot air circulation dryer at a temperature of 110° C. for 2 minutes, to form a moisture-proof coating layer. A moisture-proof paper sheet was obtained. The resultant moisture-proof paper sheet was subjected to the tests. The test results are shown in Table 1.

Examples 2 to 5

In each of Examples 2 to 5, a moisture-proof paper sheet was produced and tested by the same procedures as in Example 1, with the following exceptions.

As a plate crystalline phyllosilicate compound particles, a moscovite pigment (trademark: Mica A11, made from Yamaguchi Unmokogyosho) having an average particle size of 5 μm and an aspect ratio of 20 to 30 was used in Example 2; a moscovite pigment (trademark: Mica A61, made by Yamaguchi Unmokogyosho) having an average particle size of 50 μm and an aspect ratio of 20 to 30 was used in Example 3; a talc pigment (trademark: Shyuen, made by Chuo Kaolin) having an average particle size of 15 μm and an aspect ratio of 5 to 10 was used in Example 4; and a sericite pigment (trademark: Sericite ST, made by Horie Kako) having an average particle size of 14 μm and an aspect ratio of 20 to 30.

The test results are shown in Table 1.

Examples 6 to 9

In each of Examples 6 to 9, a moisture-proof paper sheet was produced and tested by the same procedures as in Example 1 with the following exceptions.

As a moisture-proofness-enhancing agent (c), a melamine-formaldehyde condensation reaction product (trademark: U-RAMIN P-6300, made by Mitsuitoatsu) having a solid content of 80% by weight was used in Example 6; a polyamidepolyurea-formaldehyde condensation reaction product (trademark: Sumirez resin 302, made by Sumitomo Kagaku) having a solid content of 60% by weight was used in Example 7; zirconiumammonium carbonate (trademark: Zircozol AC-7, made by Daiichi Kigenso) having a solid content of 13% by weight was used in Example 8, and glyoxal (made by Wako Junyaku) having a solid content of 40% by weight was used in Example 9.

The test results are shown in Table 1.

Examples 10 to 13

In each of Examples 10 to 13, a moisture-proof paper sheet was produced and tested by the same procedures as in Example 1, with the following exceptions.

The carboxylic acid-modified SBR latex (LX407S1X1) of Example 1 was replaced by a carboxylic acid modified SBR latex (trademark: PT1120, made by Nihon Zeon) having an acid modification of about 15%, a Tg of 2° C. and a solid content of 48% by weight in Example 10, by a mixture of 40 parts by weight of a carboxylic acid-modified SBR latex (trademark: OX1060, made by Nihon Zeon) having an acid modification of about 3%, a Tg of 8° C. and a solid content of 50% by weight, with 8 parts by weight of the same carboxylic acid modified SBR latex (LX407S1X1) as in Example 1 was used in Example 11; by a mixture of 43 parts by weight of the same carboxylic acid-modified SBR latex as in Example 1 with 5 parts by weight of the same carboxylic acid-modified SBR latex as in Example 10 in Example 12; and by a mixture of 43 parts by weight of the same carboxylic acid-modified SBR latex (OX1060) as in Example 11 with 5 parts by weight of an acrylic polymer latex (trademark: Aron A104, made by Toa Gosei) having a Tg of 40° C., an acid-modification of about 10% and a solid content of 40% by weight in Example 13.

The test results are shown in Table 1.

Comparative Example 1

A polyethylene resin was laminated on a surface of an unbleached kraft paper sheet to form a coating layer having a thickness of 15 μm. The resultant polyethylene-laminated paper sheet was subjected to the tests. The test results are shown in Table 1.

Comparative Example 2

A moisture-proof paper sheet was produced by coating a surface of an unbleached, kraft paper sheet having a basis weight of 70 g/m$^2$ with a coating liquid containing a mixture of 65 parts by weight of the same carboxylic acid-modified SBR latex (LX407S1X1) as in Example 1 and 35 parts by weight of a wax emulsion (trademark: OKW-40, made by Arakawa Kagaku) containing a mixed emulsion of paraffin wax, polybutene and a rosin resin and having a solid content of 45% by weight by using a mayer bar, and drying the coating liquid layer at a temperature of 110° C. for one minute, to provide a dry moisture-proof coating layer having a weight of 20 g/m$^2$.

The resultant comparative moisture-proof paper sheet was subjected to the tests.

The test results are shown in Table 1.

Comparative Examples 3 and 4

In each of Comparative Examples 3 and 4, a comparative moisture-proof paper sheet was produced and 5 tested by the same procedures as in Example 1, except that for the plate crystalline phyllosilicate compound particles (Mica A21) of Example 1, a talc pigment (trademark: PC talc, made by Daio Engineering), having an average particle size of 2 μm and an aspect ratio of 2 to 4 was used in Comparative Example 3, and a moscovite pigment (trademark: Mica B72, made by Yamaguchi Unmokogyosho) having an average particle size of 82 μm and an aspect ratio of 20 to 30 was used in Comparative Example 4.

The test results are shown in Table 1.

Comparative Example 5

A comparative moisture-proof paper sheet was produced and tested by the same procedures as in Example 1, except that the carboxylic acid-modified SBR latex (LX407S1X1) and the moscovite pigment (Mica A-21) were employed in a mixing weight ratio of 50/50, and no moisture-proofness-enhancing agent (c) was used.

The test results are shown in Table 1.

Comparative Example 6

A comparative moisture-proof paper sheet was produced and tested by the same procedures as in Example 10, except that the carboxylic acid-modified SBR latex (PT1120) and the moscovite pigment (Mica A-21) were employed in a mixing weight ratio of 50/50, and no moisture-proofness-enhancing agent (c) was used.

The test results are shown in Table 1.

Comparative Example 7

A comparative moisture-proof paper sheet was produced and tested by the same procedures as in Example 1, except that the coating liquid was prepared from the same carboxylic acid modified SBR latex (OX1060) as in Example 11 and the same moscovite pigment (Mica A21) as in Example 1, in a mixing weight ratio of 50/50. No moisture-proofness-enhancing agent was employed.

The test results are shown in Table 1.

TABLE 1

| Example No. | | Synthetic resin (a) | Pigment particles (b) Type | Average particle size (μm) | Aspect ratio | Moisture proofness-enhancing agent (c) | Water vapor permeability (g/m² · 24 hr) | Friction coefficient | Blocking resistance | Re-pulping property (Test method-1) |
|---|---|---|---|---|---|---|---|---|---|---|
| Example | 1 | Acid modified SBR (LX407S1X1) | Moscovite | 20 | 20–30 | Sorbitolglycidylether | 45 | 0.54 | 3 | good |
| | 2 | Acid modified SBR (LX407S1X1) | Moscovite | 5 | 20–30 | " | 58 | 0.56 | 3 | " |
| | 3 | Acid modified SBR (LX407S1X1) | Moscovite | 50 | 20–30 | " | 50 | 0.53 | 3 | " |
| | 4 | Acid modified SBR (LX407S1X1) | Talc | 15 | 5–10 | " | 52 | 0.55 | 3 | " |
| | 5 | Acid modified SBR (LX407S1X1) | Sericite | 14 | 20–30 | " | 49 | 0.55 | 3 | " |
| | 6 | Acid modified SBR (LX407S1X1) | Moscovite | 20 | 20–30 | Melamine-formaldehyde resin | 43 | 0.53 | 3 | " |
| | 7 | Acid modified SBR (LX407S1X1) | " | " | " | Polyamidepolyurea-formaldehyde resin | 45 | 0.57 | 3 | " |
| | 8 | Acid modified SBR (LX407S1X1) | " | " | " | Zirconiumammonium carbonate | 50 | 0.52 | 3 | " |
| | 9 | Acid modified SBR (LX407S1X1) | " | " | " | Glyoxal | 46 | 0.52 | 3 | " |
| | 10 | Acid modified SBR (PT1120) | " | " | " | Sorbitolglycidylether | 48 | 0.51 | 3 | " |
| | 11 | OX1060/LX40751X1 (40/8) | " | " | " | " | 35 | 0.52 | 3 | " |
| | 12 | OX1060/PT1120 (43/5) | " | " | " | " | 33 | 0.52 | 3 | " |
| | 13 | OX1060/Aron A104 (43/5) | " | " | " | " | 38 | 0.56 | 3 | " |
| Comparative Example | 1 | Polyethylene | — | — | — | — | 45 | 0.55 | 3 | bad |
| | 2 | LX407S1X1/wax | — | — | — | — | 40 | 0.21 | 3 | good |
| | 3 | LX407S1X1 | Talc | 2 | 2–4 | Sorbitolglycidylether | 110 | 0.54 | 2 | " |
| | 4 | " | Moscovite | 82 | 20–30 | " | 98 | 0.54 | 3 | " |
| | 5 | LX407S1X1 | Moscovite | 20 | 20–30 | — | 52 | 0.55 | 2 | " |
| | 6 | PT1120 | " | " | " | — | 48 | 0.53 | 1 | " |
| | 7 | 0X1060 | " | " | " | — | 39 | 0.55 | 1 | " |

Table 1 clearly shows that the resultant moisture-proof paper sheets of Examples 1 to 13 in accordance with the present invention had a higher re-pulping property than that of the polyethylene-laminated paper sheet of Comparative Example 1, and a higher resistance to slippage than the wax-containing coating paper sheet of Comparative Example 2.

Also, when the pigment did not satisfy the requirements of the present invention for the average particle size and the aspect ratio, as shown in Comparative Examples 3 and 4, the resultant moisture-proof paper sheets exhibited an unsatisfactory moisture-proofing property.

Further, as shown in Comparative Examples 5, 6 and 7, when the moisture-proofness-enhancing agent (c) of the present invention is not employed, the resultant moisture-proof paper sheets exhibited an unsatisfactory blocking resistance.

Example 14

A solution of 10% by weight of a glycidoxy-silane coupling agent (trademark: KBM403, made by Shinetsu Kagakukogyo) in toluene was prepared. The silane coupling solution in an amount of 10 parts by weight was added dropwise to 100 parts by weight of a moscovite pigment (trademark: Mica A21) having an average particle size of 20 μm and an aspect ratio of 20 to 30 and dried at a temperature of 120° C. for one hour, while agitating the resultant mixture at an agitation speed of 1000 rpm for 10 minutes, and then the mixture was dried at a temperature of 80° C. for 2 hours. A coupling agent surface-treated moscovite pigment (a) was obtained.

The coupling agent surface-treated moscovite pigment (a) in an amount of 100 parts by weight was mixed with 100 parts by weight of water and 0.2 parts by weight of a polyacrylic acid-containing dispersing agent (trademark: Carribon L400, made by Toa Gosei), and the mixture was agitated in a Cowless disperser at an agitating speed of 2000 rpm for 30 minutes.

The resultant mixture was further mixed with a carboxylic acid-modified SBR latex (trademark: LX407S1X1, made by Nihon Zeon) having a solid content of 48% by weight and a synthetic resin water vapor permeability of 120 g/m2·24 hr, in a solid weight ratio of the moscovite pigment (phyllosilicate compound) to the synthetic resin of 50/50, to provide a coating liquid.

The coating liquid was coated, by using a mayer bar, on a surface of an unbleached kraft paper sheet having a basis weight of 70 g/m², and the coating liquid layer was dried at a temperature of 110° C. for 2 minutes to form a moisture proof coating layer having a dry weight of 30 g/m². The resultant moisture-proof paper sheet was subjected to the tests.

The test results are shown in Table 2.

Example 15

A solution of 10% by weight of a methacryloxy silane coupling agent (trademark: KBM503, made by Shinetsu Kagakukogyo) in toluene was prepared. The silane coupling solution in an amount of 10 parts by weight was added dropwise to 100 parts by weight of a moscovite pigment (trademark: Mica A21) having an average particle size of 20 μm and an aspect ratio of 20 to 30 and dried at a temperature of 120° C. for one hour, while agitating the resultant mixture at an agitation speed of 1000 rpm for 10 minutes, and then the mixture was dried at a temperature of 80° C. for 2 hours. A coupling agent surface-treated moscovite pigment (b) was obtained.

The coupling agent surface-treated moscovite pigment (b) in an amount of 100 parts by weight was mixed with 95 parts by weight of water, 5 parts by weight of isopropylalcohol, 0.2 parts by weight of a polyacrylic acid-containing dispersing agent (trademark: Carribon L400, made by Toa Gosei) and 0.4 parts by weight of a surfactant (trademark: Tabro U99 made by San Nopio) and the mixture was agitated in a Cowless disperser at an agitating speed of 2000 rpm for 30 minutes.

The resultant mixture was further mixed with a carboxylic acid-modified SBR latex (trademark: LX407S1X1, made by Nippon Zeon) having a solid content of 48% by weight and a synthetic resin water vapor permeability of 120 g/m$^2$·24 hr, in a solid weight ratio of the moscovite pigment (phyllosilicate compound) to the synthetic resin of 50/50, to provide a coating liquid.

The coating liquid was coated, by using a mayer bar, on a surface of an unbleached kraft paper sheet having a basis weight of 70 g/m$^2$, and the coating liquid layer was dried at a temperature of 110° C. for 2 minutes to form a moisture proof coating layer having a dry weight of 30 g/m$^2$. The resultant moisture-proof paper sheet was subjected to the tests.

The test results are shown in Table 2.

Example 16

A coupling agent surface-treated moscovite pigment (c) was prepared by the same procedures as in Example 14, except that the glycidoxysilane coupling agent (KBM403) was replaced by an aminosilane coupling agent (trademark: KBM603, made by Shinetsu Kagakukogyo).

The coupling agent surface-treated moscovite pigment (c) in an amount of 100 parts by weight was mixed with 80 parts by weight of water, 20 parts by weight of a 5% by volume ammonia water and 0.2 parts by weight of a polyacrylic acid-containing dispersing agent (trademark: Carribon L400, made by Toa Gosei) and the mixture was agitated in a Cowless disperser at an agitating speed of 2000 rpm for 30 minutes.

The resultant mixture was further mixed with a carboxylic acid-modified SBR latex (trademark: LX407S1X1, made by Nippon Zeon) having a solid content of 48% by weight and a synthetic resin water vapor permeability of 120 g/m$^2$·24 hr, in a solid weight ratio of the moscovite pigment (phyllosilicate compound) to the synthetic resin of 50/50, to provide a coating liquid.

The coating liquid was coated, by using a mayer bar, on a surface of an unbleached kraft paper sheet having a basis weight of 70 g/m$^2$, and the coating liquid layer was dried at a temperature of 110° C. for 2 minutes to form a moisture proof coating layer having a dry weight of 30 g/m$^2$. The resultant moisture-proof paper sheet was subjected to the tests.

The test results are shown in Table 2.

Examples 17 and 18

In each of Examples 17 and 18, a moisture-proof paper sheet was produced and tested by the procedures as in Example 15, except that in the preparation of the coupling agent surface-treated mica pigment, the methacryloxysilane coupling agent was replaced by a stearoyl titanate coupling agent (trademark: KRET, made by Ajinomoto) to provide a coupling agent surface-treated mica pigment (d) in Example 17; and by an isopropyl aluminum coupling agent (trademark: AL-M, made by Ajinomoto), to provide a coupling agent surface-treated mica pigment (e) in Example 18.

The test results are shown in Table 2.

Examples 19 and 20

In each of Examples 19 and 20, a moisture-proof paper sheet was produced and tested by the same procedures as in Example 14 with the following exceptions.

In the preparation of the coupling agent surface-treated mica pigment, the moscovite pigment (KBM403) was replaced, in Example 19, by a sericite pigment (trademark: Sericite KF1325, made by Chuo Kaolin) having an average particle size of 13 μm and an aspect ratio of 20 to 30, to provide a coupling agent surface-treated mica pigment (f); and in Example 20, by a talc pigment (trademark: Shuen, made by Chuo Kaolin) having an average particle size of 18 μm and an aspect ratio of 5 to 10, to provide a coupling agent surface-treated talc pigment (g).

The test results are shown in Table 2.

Example 21

A mixture was prepared from 100 parts by weight of the moscovite pigment (Mica A21), 0.2 parts of the dispersing agent (Carribon L400) and 100 parts by weight of water, and subjected to a dispersion treatment using a Cowless disperser at an agitation speed of 2000 rpm for 30 minutes.

A coating liquid was prepared by mixing the moscovite pigment dispersion with the carboxylic acid-modified SBR latex (LX407S1X1) and the glycidoxysilane coupling agent (KBM403) in a mixing ratio in solid weight, moscovite pigment/modified SBR/coupling agent, of 50/50/0.5.

The coating liquid was coated on a surface of an unbleached kraft paper sheet having a basis weight of 70 g/m$^2$, by using a mayer bar, and dried at a temperature of 110° C. for 2 minutes, to form a moisture-proof coating layer having a dry weight of 30 g/m$^2$. A moisture-proof paper sheet was obtained.

The test results are shown in Table 2.

Example 22

A mixture was prepared from 100 parts by weight of the moscovite pigment (Mica A21), 1 part by weight of the glycidoxysilane coupling agent (KBM403), 0.2 parts of the dispersing agent (Carribon L400) and 100 parts by weight of water, and subjected to a dispersion treatment using a Cowless disperser at an agitation speed of 2000 rpm for 30 minutes.

A coating liquid was prepared by mixing the moscovite pigment dispersion with the carboxylic acid-modified SBR latex (LX407S1X1) in a mixing ratio in solid weight, moscovite pigment/modified SBR, of 50/50.

The coating liquid was coated on a surface of an unbleached kraft paper sheet having a basis weight of 70 g/m$^2$, by using a mayer bar, and dried at a temperature of 110° C. for 2 minutes, to form a moisture-proof coating layer having a dry weight of 30 g/m$^2$. A moisture-proof paper sheet was obtained.

The test results are shown in Table 2.

Examples 23 and 24

In each of Examples 23 and 24, a moisture-proof paper sheet was produced and tested by the same procedures as in Example 14 with the following exceptions.

In the preparation of the coupling agent surface-treated pigment, the moscovite pigment (Mica A21) was replaced, in Example 23, by a moscovite pigment (trademark: Mica A11, made by Yamaguchi Unmokogyosho) having an average particle size of 5 μm and an aspect ratio of 20 to 30, to provide a coupling agent surface-treated mica pigment (h), and in Example 24, by a moscovite pigment (trademark: Mica A61, Yamaguchi Unmokogyosho) having an average particle size of 50 μm and an aspect ratio of 20 to 30, to provide a coupling agent surface-treated mica pigment (i).

The test results are shown in Table 3.

Examples 25 to 29

In each of Examples 25 to 29, a moisture-proof paper sheet was produced and tested by the same procedures as in Example 14 except that the synthetic resin component (a) consisted of the following material.

Example 25: Carboxylic acid-modified SBR latex (trademark: OX1060, made by Nihon Zeon) having a solid content of 50% by weight and a synthetic resin water vapor permeability of 160 g/m$^2$·2 hr.

Example 26: Modified SBR latex (trademark: Polylac 686A3, made by Mitstuitoatsu Kagaku) having a solid content of 50% by weight and a synthetic resin water vapor permeability of 317 g/m$^2$·24 hr.

Example 27: Modified SBR latex (trademark: JO569, Nihon Goseigomu) having a solid content of 48% by weight and a synthetic resin permeability of 200 g/m$^2$·24 hr.

Example 28: Modified SBR latex (trademark: Polylac 760K-10R, made by Mitsuitoatsu) having a solid content of 48% by weight and a synthetic resin water vapor permeability of 460 g/m$^2$·24 hr.

Example 29: Acryl-stylene copolymer latex (trademark: Aron A104, made by Toa Gosei) having a solid content of 40% by weight and a synthetic resin water vapor permeability of 450 g/m$^2$·24 hr.

The test results are shown in Table 3.

Comparative Examples 8 to 12

In each of Comparative Examples 8 to 12, a comparative moisture-proof paper sheet was produced and tested by the same procedures as in Example 14, with the following exceptions.

In Comparative Example 8, the coupling agent surface-treated moscovite pigment (a) was replaced by the non-surface-treated moscovite pigment (Mica A21).

In Comparative Example 9, the coupling agent surface-treated moscovite pigment (a) was replaced by the non-surface-treated sericite pigment (Sericite KF1325).

In Comparative Example 10, the coupling agent surface-treated moscovite pigment (a) was replaced by the non-surface-treated talc pigment (Shuen).

In Comparative Example 11, in the preparation of the coupling agent surface-treated pigment, the moscovite pigment (Mica A21) was replaced by a talc pigment (trademark: PC talc, made by Daio Engineering) having an average particle size of 2 μm and an aspect ratio of 2 to 4, to provide a coupling agent surface-treated talc pigment (j).

In Comparative Example 12, in the preparation of the coupling agent surface-treated pigment, the moscovite pigment (Mica A21) was replaced by a moscovite pigment (trademark: Mica B72, made by Yamaguchi Unmokogyosho) having an average particle size of 82 μm and an aspect ratio of 20 to 30, to provide a coupling agent surface-treated moscovite pigment (k).

The test results are shown in Table 2 and 3.

TABLE 2

| Example No. | | Synthetic resin (a) | Plate crystalline particles (b) | Moisture proofness-enhancing agent (coupling agent) | Treatment method | Moisture-proof paper sheet: Water vapor permeability (g/m$^2$ · 24 hr) | Moisture-proof paper sheet: Re-pulping property (Test method-2) |
|---|---|---|---|---|---|---|---|
| Example | 14 | Modified SBR | Moscovite | Glycidoxysilane | Dry surface treatment | 19 | good |
| | 15 | " | " | Methacroxysilane | Dry surface treatment | 28 | " |
| | 16 | " | " | Aminosilane | Dry surface treatment | 17 | " |
| | 17 | " | " | Stearoyl titanate | Dry surface treatment | 30 | " |
| | 18 | " | " | Isopropyl aluminum | Dry surface treatment | 31 | " |
| | 19 | " | Sericite | Glycidoxysilane | Dry surface treatment | 33 | " |
| | 20 | " | Talc | " | Dry surface treatment | 36 | " |

TABLE 2-continued

| Example No. | | Synthetic resin (a) | Plate crystalline particles (b) | Moisture proofness-enhancing agent (coupling agent) | Treatment method | Moisture-proof paper sheet: Water vapor permeability ($g/m^2 \cdot 24$ hr) | Moisture-proof paper sheet: Re-pulping property (Test method-2) |
|---|---|---|---|---|---|---|---|
| | 21 | " | Moscovite | " | Integral blend method | 29 | " |
| | 22 | " | " | " | Wet pre-treatment | 27 | " |
| Comparative Example | 8 | " | " | — | — | 52 | " |
| | 9 | " | Sericite | — | — | 59 | " |
| | 10 | " | Talc | — | — | 57 | " |

TABLE 3

| Example No. | | Synthetic resin (a) | Plate crystalline particles (b): Type | Plate crystalline particles (b): Average particle size (μm) | Plate crystalline particles (b): Aspect ratio | Moisture proofness-enhancing agent (c) (coupling agent) | Treatment method | Moisture-proof paper sheet: Water vapor permeability ($g/m^2 \cdot 24$ hr) | Moisture-proof paper sheet: Re-pulping property (Test method-1) |
|---|---|---|---|---|---|---|---|---|---|
| Example | 23 | LX407S1X1 | Moscovite | 5 | 20–30 | Glycidoxysilane | Dry surface treatment | 45 | good |
| | 24 | " | " | 50 | " | " | Dry surface treatment | 30 | " |
| | 25 | OX1060 | " | 20 | " | " | Dry surface treatment | 22 | " |
| | 26 | 686A3 | Moscovite | 20 | " | " | Dry surface treatment | 35 | " |
| | 27 | J0569 | " | " | " | " | Dry surface treatment | 24 | " |
| | 28 | 760K | " | " | " | " | Dry surface treatment | 40 | " |
| | 29 | A104 | " | " | " | " | Dry surface treatment | 38 | " |
| Comparative Example | 11 | LX407S1X1 | Talc | 2 | 2–4 | " | Dry surface treatment | 91 | " |
| | 12 | " | Moscovite | 82 | 20–30 | " | Dry surface treatment | 77 | " |

Tables 2 and 3 clearly show that the moisture-proof paper sheets of Examples 14 to 29 produced by using the coupling agent as a moisture-proofness-enhancing agent (c) in accordance with the present invention exhibited an excellent moisture-proofing performance and a satisfactory re-pulping property for practice.

Example 30

A coating liquid prepared by mixing 100 parts by weight of a moscovite pigment (trademark: Mica AB32, made by Yamaguchi Unmokogyosho) having an average particle size of 22 μm and an aspect ratio of 20 to 30 with 100 parts by weight of water; dispersing the mixture by using Cowless disperser at an agitation speed of 2000 rpm for 2 hours; mixing the dispersion with a methyl methacrylate-ethyl acrylate-methacrylic acid copolymer (polymerization molar ratio: 50/30/25, Tg: 55° C.) in a mixing ratio in dry solid weight of the moscovite pigment to the copolymer of 50:50; and further admixing the mixture with dimethylamine in a molar equivalent amount to the content of methacrylic acid in the copolymer.

The coating liquid was coated on a surface of an unbleached kraft paper sheet having a basis weight of 70 $g/m^2$ by using a mayer bar, and the coating liquid layer was dried at a temperature of 110° C. for 2 minutes to form a coating layer having a dry weight of 15 $g/m^2$. The resultant moisture-proof paper sheet was subjected to the tests. The test results are shown in Table 4.

Comparative Example 15

A comparative moisture-proof paper sheet was produced and tested by the same procedures as in Example 30 with the following exceptions.

A coating liquid was prepared by mixing 65 parts by weight of a SBR latex (trademark: T2004F, made by Nihon goseigomu) with 35 parts by weight of a wax emulsion (trademark: OKW-40, an aqueous emulsion of a mixture of paraffin wax with polybutene and rosin resin, made by Arakawa Kagakukogyo).

The coating liquid was coated on a surface of an unbleached kraft paper sheet having a basis weight of 70 g/m$^2$ by using a mayer bar, and the coating liquid layer was dried at a temperature of 110° C. for 2 minutes to form a coating layer having a dry weight of 20 g/m$^2$. The resultant moisture-proof paper sheet was subjected to the tests. The test results are shown in Table 4.

Comparative Example 14

A comparative moisture-proof paper sheet was produced and tested by the same procedures as in Example 30, with the following exceptions.

The moscovite pigment (Mica AB32) was replaced by a talc pigment (trademark: PC talc, made by Daio Engineering) having an average particle size of 2 μm and an aspect ratio of 2 to 4.

The test results are shown in Table 4.

Comparative Example 15

A comparative moisture-proof paper sheet was produced and tested by the same procedures as in Example 30, with the following exceptions.

The moscovite pigment (Mica AB32) was replaced by a moscovite pigment (trademark: Mica AB32, made by Yamaguchi Unmokogyosho) having an average particle size of 82 μm and an aspect ratio of 20 to 30.

The test results are shown in Table 4.

trademark: Sericite KF1325, made by Chuo Kaolin) having an average particle size of 13 μm and an aspect ratio of 20 to 30, while agitating the admixture in a Cowless disperser at an agitation speed of 2000 rpm for 30 minutes.

The coating liquid was hand-coated on a surface of an unbleached kraft paper sheet having a basis weight of 70 g/m$^2$, by using a mayer bar, and dried in a hot air circulation dryer at a temperature of 120° C. for one minute to form a moisture-proof coating layer having a dry weight of 30 g/m$^2$. A moisture-proof paper sheet was obtained and subjected to the tests.

The test results are shown in Table 5.

Examples 32–43 and Comparative Example 16

In each of Examples 32 to 43 and Comparative Example 16, a moisture-proof paper sheet was produced and tested by the same procedures as in Example 31, except that in place of xylenediamine as a moisture-proofness-enhancing agent (c), the following compounds were employed.

Example 32: Ethylenediamine (aliphatic polyamine, made by Wako Junyaku Kogyo)

Example 33: Triethylenetetramine (aliphatic polyamine, made by Wako Junyaku Kogyo)

Example 34: Epoxy-modified xylenediamine (modified amine, trademark: EH265, made by Asahi Denkakogyo)

Example 35: Acrylonitrile-modified xylene-diamine (modified amine, trademark: X13A made by Sanwa Kagakukogyo)

Example 36: Octylamine (aliphatic monoamine, made by Wako Junyakukogyo)

Example 37: m-Phenylenediamine (aromatic amine, made by Wako Junyakukogyo)

Example 38: Pyrrolidine (sec-amine, made by Wako Junyakukogyo)

Example 39: Hexamethylenetetramine (tert-amine, made by Wako Junyakukogyo)

Example 40: Searyldimethylbenzyl ammonium chloride (quaternary ammonium salt, trademark: Cation S, made by Sanyo Kagakukogyo)

Example 41: Betaine lauryldimethylamino acetate (Betaine compound, trademark: Obazoline LB, made by Toho Kagakukogyo)

TABLE 4

| Example No. | Synthetic resin (a) | Plate crystalline particles (b) Type | Average particle size (μm) | Aspect ratio | Moisture proofness-enhancing agent (c) | Coating layer (g/m$^2$) | Water vapor permeability (g/m$^2$ · 24 hr) | Frictional coefficient |
|---|---|---|---|---|---|---|---|---|
| Example 30 | MMA/EA/MA copolymer | Moscovite | 22 | 20–30 | Dimethylamine | 15 | 45 | 0.53 |
| Comparative Example 13 | T2004F/wax | — | — | — | — | 20 | 40 | 0.23 |
| 14 | MMA/EA/MA copolymer | Talc | 2 | 2–4 | Dimethylamine | 15 | 113 | 0.55 |
| 15 | " | Moscovite | 82 | 20–30 | " | 15 | 121 | 0.51 |

Example 31

A coating liquid prepared by mixing 50 parts by weight of water with I part by weight of xylenediamine (an aromatic ring structure-containing aliphatic polyamine, made by Wako Junyaku Kogyo) and 50 parts by weight of a carboxylic acid-modified SBR latex (synthetic resin (a), trademark: LX407S1X1) having a solid content of 48%, while stirring the mixture; admixing the mixture with 50 parts by weight of a sericite pigment (phyllosilicate compound particles (b), Example 42: A poly-condensation reaction product of a polymerized fatty acid with polyethylenepolyamine (polyamide resin, trademark: 315H, made by Sanwa Kagakukogyo)

Example 43: A poly-condensation reaction product of linolein dimer with ethylene-diamine (polyamide resin, trademark: Versamid, General Mill)

Comparative Example 16: No moisture-proofness-enhancing agent was employed.

The test results are shown in Table 5.

TABLE 5

| Example No. | Plate crystalline particles (b) | Synthetic resin (a) | Amine or Amide | Water vapor permeability ($g/m^2 \cdot 24$ hr) | Re-pulping property (Test method-2) |
|---|---|---|---|---|---|
| 31 | Sericite (13 μm) | SBR (LX407) | Xylenediamine | 37 | good |
| 32 | Sericite (13 μm) | SBR (LX407) | Ethylenediamine | 39 | " |
| 33 | Sericite (13 μm) | SBR (LX407) | Triethylenediamine | 40 | " |
| 34 | Sericite (13 μm) | SBR (LX407) | Epoxy-modified tetraethylpentamine | 36 | " |
| 35 | Sericite (13 μm) | SBR (LX407) | Acrylonitrile-modified xylene-diamine | 36 | " |
| 36 | Sericite (13 μm) | SBR (LX407) | Octyl amine | 39 | " |
| 37 | Sericite (13 μm) | SBR (LX407) | m-Phenylene-diamine | 45 | " |
| 38 | Sericite (13 μm) | SBR (LX407) | Pyrrolidine | 42 | " |
| 39 | Sericite (13 μm) | SBR (LX407) | Hexamethylene-tetramine | 39 | " |
| 40 | Sericite (13 μm) | SBR (LX407) | Stearyldimethyl-benzyl ammonium chloride | 44 | " |
| 41 | Sericite (13 μm) | SBR (LX407) | Betaine lauryl-dimethylamino-acetate | 45 | " |
| 42 | Sericite (13 μm) | SBR (LX407) | Polyamide (315H) | 42 | " |
| 43 | Sericite (13 μm) | SBR (LX407) | Polyamide (Versamide) | 46 | " |
| Comparative Example 16 | Sericite (13 μm) | SBR (LX407) | None | 59 | " |

Examples 44–48 and Comparative Examples 17 to 19

In each of Examples 44 to 49 and Comparative Examples 17 and 18, a moisture-proof paper sheet was produced and tested by the same procedures as in Example 31, except that in place of the sericite pigment (Sericite KF1325) as a plate crystalline phyllosilicate compound particles (b), the following pigment was employed.

Example 44: Moscovite pigment (Mica A21) having an average particle size of 20 μm Example 45: Talc pigment (Shuen) having an average particle size of 15 μm Comparative Example 17: Kaolin pigment (trademark: Hydraprint, made by Nisei Kyoeki K.K.) having an average particle size of 2 μm and an aspect ratio of 5 to 10

Example 46: Moscovite pigment (Mica A11) having an average size of 5 μm

Example 47: Moscovite pigment (Mica A31) having an average particle size of 33 μm and an aspect ratio of 20 to 30

Example 48: Moscovite pigment (trademark: Mica A51, made by Yamaguchi Unmokogyosho) having an average particle size of 45 μm and an aspect ratio of 20 to 30

Comparative Example 18: Moscovite pigment (trademark: #4-K, made by KMG MINERALS) having an average particle size of 55 μm and an aspect ratio of 20 to 30

Comparative Example 19: Calcium carbonate pigment (trademark: Softon BF-100, made by Bihoku Funka) having an average particle size of 3.5 μm and an aspect ratio of about 1 to 2

The test results are shown in Table 6.

TABLE 6

| Example No. | | Plate crystalline particles (b) | Synthetic resin (a) | Amine compound | Water vapor permeability ($g/m^2 \cdot 24$ hr) | Re-pulping property (Test method-2) |
|---|---|---|---|---|---|---|
| Example | 44 | Moscovite (20 μm) | SBR (LX407S1X1) | Xylenediamine | 30 | good |
| | 45 | Talc (15 μm) | SBR (LX407S1X1) | " | 45 | " |
| Comparative Example | 17 | Kaolin (2 μm) | SBR (LX407S1X1) | " | 56 | " |
| Example | 46 | Moscovite (5 μm) | SBR (LX407S1X1) | " | 45 | " |
| Example | 47 | Moscovite (33 μm) | SBR (LX407S1X1) | " | 31 | " |
| | 48 | Moscovite | SBR | " | 43 | " |

TABLE 6-continued

| Example No. | Plate crystalline particles (b) | Synthetic resin (a) | Amine compound | Water vapor permeability ($g/m^2 \cdot 24$ hr) | Re-pulping property (Test method-2) |
|---|---|---|---|---|---|
| | (45 μm) | (LX407S1X1) | | | |
| Comparative Example 18 | Moscovite (55 μm) | SBR (LX407S1X1) | " | 52 | " |
| 19 | Calcium carbonate (3.5 μm) | SBR (LX407S1X1) | " | 95 | " |

Examples 49 to 52

In each of Examples 49 to 52, a moisture-proof paper sheet was produced and tested by the same procedures as in Example 31, except that carboxylic acid-modified SBR 5 latex (LX407S1X1) was replaced by each of the following synthetic resin latexes.

Example 49: Carboxylic acid-modified SBR latex (OX1060)

Example 50: Modified SBR latex (686A3)

Example 51: Acryl-styrene copolymer latex (Aron A-104)

Example 52: Modified NBR (trademark: LX550, made by Nippon Zeon)

The test results are shown in Table 7.

TABLE 7

| Example No. | Plate crystalline particles (b) | Synthetic resin (a) | Amine compound (c) | Water vapor permeability ($g/m^2 \cdot 24$ hr) | Re-pulping property (Test method-2) |
|---|---|---|---|---|---|
| 49 | Sericite (13 μm) | SBR (0X1060) | Xylenediamine | 38 | good |
| 50 | Sericite (13 μm) | SBR (686A3) | " | 39 | " |
| 51 | Sericite (13 μm) | Ac—St copolymer (A104) | " | 45 | " |
| 52 | Sericite (13 μm) | NBR (LX 550) | " | 49 | " |

Example 53

A mixture of 50 parts by weight of water with 1 part by weight of xylenediamine, 0.5 part by weight of an aminosilane coupling agent (N-β(aminoethyl)-γ-aminopropyltrimethoxysilane, trademark: KBM603, made by Shinetsu Kagakukogyo) and 50 parts by weight of a modified SBR latex (LX407S1X1) was agitated. Then, the mixture was admixed with 50 parts by weight of a sericite pigment (Sericite KF 1325) having an average particle size of 13 μm, as a phyllosilicate compound particles (b), and the resultant mixture was agitated in a Cowless disperser at an agitating speed of 2000 rpm for 30 minutes, to prepare a coating liquid.

The coating liquid was hand coated, by using a mayer bar, on a surface of an unbleached kraft paper sheet having a basis weight of 70 $g/m^2$, and dried in a hot air circulation dryer at a temperature of 120° C. for one minute, to prepare a moisture-proof coating layer having a dry weight of 30 $g/m^2$. A moisture-proof paper sheet was obtained.

The test results are shown in Table 8.

Examples 54 to 58

In each of Examples 54 to 58, a moisture-proof paper sheet was produced and tested by the same procedures as in Example 53, except that the aminosilane coupling agent of Example 53 was replaced by the coupling agents as shown below.

Example 54: Epoxysilane coupling agent (γ-glycidoxypropyltrimethoxysilane, trademark: KBM403, Shinetsu Kagakukogyo)

Example 55: Vinylsilan coupling agent (vinyltrimethoxysilane, trademark: KBM1003, made by Shinetsu Kagakukogyo)

Example 56: Methacryloxysilane coupling agent (γ-methacryloxypropyltrimethoxysilane, trademark: KBM503, made by Shinetsu Kagakukogyo)

Example 57: Methylsilane coupling agent (Methyltrimethoxysilane, trademark: KBM13, made by Shinetsu Kagakukogyo)

Example 58: Amino titanate coupling agent, trademark: KR44, made by Ajinomoto)

The test results are shown in Table 8.

TABLE 8

| Example No. | Plate crystalline particle (b)/ Synthetic resin (a)/ Amine compound (c) | Coupling agent | Water vapor permeability ($g/m^2 \cdot 24$ hr) | Re-pulping property (Test method-2) |
|---|---|---|---|---|
| 53 | Sericite (13 μm)/ SBR (LX407S1X1)/ Xylenediamine | Aminosilane | 25 | good |
| 54 | Sericite (13 μm)/ SBR (LX407S1X1)/ Xylenediamine | Epoxysilane | 26 | " |
| 55 | Sericite (13 μm)/ SBR (LX407S1X1)/ Xylenediamine | Vinylsilane | 29 | " |
| 56 | Sericite (13 μm)/ SBR (LX407S1X1)/ Xylenediamine | Methacryloxysilane | 29 | " |
| 57 | Sericite (13 μm)/ SBR (LX407S1X1)/ Xylenediamine | Methylsilane | 30 | " |
| 58 | Sericite (13 μm)/ SBR (LX407S1X1)/ Xylenediamine | Amino titanate | 29 | " |

Tables 5 to 7 show that when the organic amine compounds and polyamide compounds shown in Examples 30 to 52 were used, the resultant moisture-proof paper sheets exhibited a satisfactory moisture proofing property and a good re-pulping property.

Also, Table 8 shows that the organic amine or polyamide compounds are employed together with the organoalkoxysilane compounds or the organoalkoxy metal compounds as shown in Examples 53 to 58, the resultant moisture-proof paper sheets exhibited a further enhanced moisture-proofing performance.

Example 59

To 50 parts by weight of water, 1 part by weight of phenolpentaethyleneglycol glycidyl ether (trademark: Denacol Ex145, made by Nagase Kaseikogyo) as a moisture-proofness-enhancing agent (c) 50 parts by solid weight of a modified SBR latex (copolymer of styrene, butadiene and carboxylic acid-containing comonomer in a molar ratio of 34/47/19, trademark: LX407S1X1, made by Nippon Zeon) having a solid content of 48% by weight, as a synthetic resin (a) were mixed and the mixture was agitated. Then, the mixture was mixed with 50 parts by weight of a sericite pigment (trademark: Sericite KF1325, made by Chuo Kaolin) having an average particle size of 13 μm and an aspect ratio of 20 to 30, as a plate crystalline phyllosilicate compound particles (b), and the resultant mixture was agitated in a Cowless disperser at an agitation speed of 2000 rpm for 30 minutes, to provide a coating liquid.

The coating liquid was hand coated on a surface of an unbleached kraft paper sheet having a basis weight of 70 $g/m^2$ by using a mayer bar, and the coating liquid layer was dried in a hot air circulation dryer at a temperature of 120° C. for one minute to provide a moisture-proof coating layer. A moisture-proof paper sheet was obtained. The test results are shown in Table 9.

Examples 60 to 63

In each of Examples 60 to 63, a moisture-proof paper sheet was produced and tested by the same procedures as in Example 59, except that in the preparation of the coating liquid, the phenolpentaethyleneglycol glycidyl ether of Example 59 was replaced by the following compounds as moisture-proofness-enhancing agents (c).

Example 60: Butyleneoxide (made by Wako Junyakukogyo)

Example 61: Phenylglycidylether (made by Wako Junyakukogyo)

Example 62: Allylglycidylether (trademark: Denacol EX-111, made by Nagase Kaseikogyo)

Example 63: Laurylalcohol-polyethyleneoxide-glycidylether (trademark: Denacol Ex171, made by Nagase Kaseikogyo)

The test results are shown in Table 9.

Examples 64 to 68

In each of Examples 64 to 68, a moisture-proof paper sheet was produced and tested by the same procedures as in Example 59, except that in the preparation of the coating liquid, the sericite pigment (Sericite KF1325) used as phyllosilicate compound particles (c) in Example 59 was replaced by the following pigments.

Example 64: Moscovite pigment (Mica A21) having an average particle size of 20 μm and an aspect ratio of 20 to 30

Example 65: Talc pigment (Shuen) having an average particle size of 15 μm and an aspect ratio of 5 to 10

Example 66: Moscovite pigment (trademark: Mica A11, made by Yamaguchi Unmokogyosho) having an average particle size of 5 μm and an aspect ratio of 20 to 30

Example 67: Moscovite pigment (trademark: Mica A31, made by Yamaguchi Unmokogyosho) having an average particle size of 33 μm and an aspect ratio of 20 to 30

Example 68: Moscovite pigment (trademark: Mica A51, made by Yamaguchi Unmokogyosho) having an average particle size of 45 μm and an aspect ratio of 20 to 30

The test results are shown in Table 10.

Examples 69 to 72

In each of Examples 69 to 72, a moisture-proof paper sheet was produced and tested by the same procedures as in Example 59, except that in the preparation of the coating liquid, the modified SBR latex used in Example 59 as a synthetic resin (a) was replaced by the following compounds.

Example 69: Modified SBR latex (styrene/butadiene comonomer/hydrophilic group-containing comonomer, molar ratio: 58/36/6, trademark: OX1060, made by Nippon Zeon)

Example 70: Modified SBR latex (styrene/butadiene comonomer/hydrophilic group-containing comonomer, molar ratio: 46/34/20, trademark: 686A3, made by Mitsuitoatsu)

Example 71: Acryl/styrene copolymer (trademark: Aron A104, made by Toa Gosei)

Example 72: NBR (trademark: LX550, made by Nippon Zeon)

The test results are shown in Table 10.

Example 73

To 50 parts by weight of water, 1 part by weight of phenolpentaethyleneglycol glycidyl ether (trademark: Denacol Ex 145, made by Nagase Kaseikogyo) as a moisture-proofness-enhancing agent (c)

0.5 parts by weight of N-β-(aminoethyl)-γ-aminopropyltrimethoxysilane (aminosilane coupling agent, trademark: KBM603, made by Shinetsu Kagakukogyo), and 50 parts by solid weight of a modified SBR latex (trademark: LX407S1X1made by Nihon Zeon) having a solid content of 48% by weight, as a synthetic resin (a) were mixed and the mixture was agitated. Then, the mixture was mixed with 50 parts by weight of a sericite pigment (trademark: Sericite KF1325, made by Chuo Kaolin) having an average particle size of 13 μm and an aspect ratio of 20 to 30, as a plate crystalline phyllosilicate compound particles (b), and the resultant mixture was agitated in a Cowless disperser at an agitation speed of 2000 rpm for 30 minutes, to provide a coating liquid.

The coating liquid was hand coated on a surface of an unbleached kraft paper sheet having a basis weight of 70 g/m$^2$, by using a mayer bar, and the coating liquid layer was dried in a hot air circulation dryer at a temperature of 120° C. for one minute to provide a 10 moisture-proof coating layer. A moisture-proof paper sheet was obtained. The test results are shown in Table 11.

Examples 74 to 78

In each of Examples 74 to 78, a moisture-proof paper sheet was produced and tested by the same procedures as in Example 73, except that in the preparation of the coating liquid, the aminosilane coupling agent used in Example 73 was replaced by the following coupling agents.

Example 74: Epoxysilane coupling agent (γ-glycidoxypropyltrimethoxysilane, trademark: KBM403, Shinetsu Kagakukogyo)

Example 75: Vinyl silane coupling agent (Vinyltrimethoxysilane, trademark: KBM1003, made by Shinetsu Kagakukogyo)

Example 76: Methacryloxysilane coupling agent (γ-methacryloxypropyltrimethoxysilane, trademark: KBM503, Shinetsu Kagakukogyo)

Example 77: Methylsilane coupling agent (methyltrimethoxysilane, trademark: KBM13, made by Shinetsu Kagakukogyo)

Example 78: Amino titanate coupling agent (isopropyltri (N-aminoethylamino-ethyl titanate, trademark: KR44, made by Ajinomoto)

The test results are shown in Table 11.

Comparative Example 20

A comparative moisture-proof paper sheet was produced and tested by the same procedures as in Example 59, except that no monoepoxy compound was employed.

The test results are shown in Table 9.

Comparative Example 21

A comparative moisture-proof paper sheet was produced and tested by the same procedures as in Example 59, except that the plate crystalline particles (c) used in Example 59 was replaced by a calcium carbonate pigment (trademark: Softon BF-100, made by Bihoku Funka) having an average particle size of 3.5 μm and an aspect ratio of about 1 to 2.

The test results are shown in Table 10.

TABLE 9

| Example No. | | Plate crystalline particles (b) | Synthetic resin (a) | Monoepoxy-compound (c) | Water vapor permeability (g/m$^2$ · 24 hr) | Re-pulping property (Test method-2) |
|---|---|---|---|---|---|---|
| Example | 59 | Sericite (13 μm) | SBR (LX407S1X1) | Phenolpentaethylene-glycol glycidyl ether | 41 | good |
| | 60 | " | SBR (LX407S1X1) | Butylene oxide | 44 | good |
| | 61 | " | SBR (LX407S1X1) | Phenylglycidyl ether | 42 | good |
| | 62 | " | SBR (LX407S1X1) | Allylglycidylether | 46 | good |

TABLE 9-continued

| Example No. | | Plate crystalline particles (b) | Synthetic resin (a) | Monoepoxy-compound (c) | Water vapor permeability ($g/m^2 \cdot 24$ hr) | Re-pulping property (Test method-2) |
|---|---|---|---|---|---|---|
| | 63 | " | SBR (LX407S1X1) | Laurylalcohol-poly-ethyleneoxide-glycidyl ether | 43 | good |
| Comparative Example | 20 | " (LX407S1X1) | SBR | None | 59 | good |

TABLE 10

| Example No. | | Plate crystalline particles (b) | Synthetic resin (a) | Monoepoxy compound | Water vapor permeability ($g/m^2 \cdot 24$ hr) | Re-pulping property (Test method-2) |
|---|---|---|---|---|---|---|
| Example | 64 | Moscovite (20 μm) | SBR (LX407S1X1) | Phenolpentaethylene-glycol glycidylether | 33 | good |
| | 65 | Talc (15 μm) | SBR (LX407S1X1) | Phenolpentaethylene glycol glycidylether | 49 | " |
| | 66 | Moscovite (5 μm) | SBR (LX407S1X1) | Phenolpentaethylene glycol glycidylether | 49 | " |
| | 67 | Moscovite (33 μm) | SBR (LX407S1X1) | Phenolpentaethylene glycol glycidylether | 36 | " |
| | 68 | Moscovite (45 μm) | SBR (LX407S1X1) | Phenolpentaethylene glycol glycidylether | 45 | " |
| Comparative Example | 21 | Calcium carbonate (3.5 μm) | SBR (LX407S1X1) | Phenolpentaethylene glycol glycidylether | 98 | " |
| Example | 69 | Sericite (13 μm) | SBR (0X1060) | " | 42 | " |
| | 70 | Sericite (13 μm) | SBR (686A3) | " | 44 | " |
| | 71 | Sericite (13 μm) | Acryl (A103) | " | 45 | " |
| | 72 | Sericite (13 μm) | NBR (LX550) | " | 49 | " |

TABLE 11

| Example No. | Plate crystalline particle (b)/ synthetic resin (a)/ monoexpoxy compound (c) | Coupling agent (c) | Water vapor permeability ($g/m^2 \cdot 24$ hr) | Re-pulping property (Test method-2) |
|---|---|---|---|---|
| 73 | Sericite (13 μm)/ SBR (LX407S1X1)/ Phenolpentaethyleneglycol glycidylether | Aminosilane | 26 | good |
| 74 | Sericite (13 μm)/ SBR (LX407S1X1)/ Phenolpentaethyleneglycol glycidylether | Epoxysilane | 27 | " |
| 75 | Sericite (13 μm)/ SBR (LX407S1X1)/ Phenolpentaethyleneglycol glycidylether | Vinyl silane | 28 | " |
| 76 | Sericite (13 μm)/ SBR (LX407S1X1)/ Phenolpentaethyleneglycol glycidylether | Methacryloxy silane | 28 | " |
| 77 | Sericite (13 μm)/ SBR (LX407S1X1)/ Phenolpentaethyleneglycol glycidylether | Methylsilane | 30 | " |
| 78 | Sericite (13 μm)/ SBR (LX407S1X1)/ Phenolpentaethyleneglycol glycidylether | Amino titanate | 30 | " |

Tables 9 to 11 show that in the moisture-proof paper sheets of Examples 59 to 78 in accordance with the present invention, the epoxy compounds contained as a moisture-proofness-enhancing agent in the coating layer contributory to enhancing the moisture-proofing performance of the paper sheet. Also, Table 11 shows that the coupling agents used together with the epoxy compounds effectively enhance the moisture proofing performance of the paper sheets. Further, all the moisture-proof paper sheets of Examples 59 to 78 exhibited a good re-pulping property.

Example 79

A mixture was prepared by mixing 50 parts by weight of water with 1 part by weight of a polyaminepolyurea resin (trademark of Sumirez resin 302, made by Sumitomo Kagakukogyo), and 50 parts by weight of the modified SBR latex (trademark: LX407S1X1) having a solid content of 48% by weight, and then agitated. Then, a coating liquid was prepared by admixing the mixture with 50 parts by weight of the sericite pigment (Sericite KF1325) having an average particle size of 13 μm and an aspect ratio of 20 to 30, and agitating the admixture in a Cowless disperser at an agitating speed of 2000 rpm for 30 minutes.

The coating liquid was hand-coated on a surface of an unbleached kraft paper sheet having a basis weight of 70 $g/m^2$ by using a mayer bar, and dried in a hot air circulation dryer at a temperature of 120° C. for one hour, to form a moisture-proof coating layer having a dry weight of 30 $g/m^2$.

A moisture-proof paper sheet was obtained.

The test results are shown in Table 12.

Examples 80 to 83

In each of Examples 80 to 83, a moisture-proof paper sheet was produced and tested by the same procedures as in Example 79, except that in the preparation of the coating liquid, the polyaminepolyurea resin (Sumirez resin 302) used in Example 79 as a moisture-proofness-enhancing agent (c) was replaced by the following compounds.

Example 80: Polyamidepolyurea resin (trademark: Sumirez resin 633, made by Sumitomo Kagakukogyo)

Example 81: Polyamideaminepolyurea resin (trademark: Sumirez resin 632, made by Sumitomo Kagakukogyo)

Example 82: Polyaminepolyurea resin (trademark: PA620, made by Nikon PMC)

Example 83: Polyamideaminepolyurea resin (trademark: PA-622, made by Nikon PMC)

The test results are shown in Table 12.

Examples 84 to 88

In each of Examples 84 to 88, a moisture-proof paper sheet was produced and tested by the same procedures as in Example 79, except that in the preparation of the coating liquid, the sericite pigment (Sericite KF1325) used us a phyllosilicate compound particles (c) in Example 79 was replaced by the following pigments.

Example 84: Moscovite pigment (Mica A21) having an average particle size of 20 μm and an aspect ratio of 20 to 30

Example 85: Talc pigment (Shuen) having an average particle size of 15 μm and an aspect ratio of 5 to 10

Example 86: Moscovite pigment (trademark Mica A11, made by Yamaguchi Unmokogyosho) having an average particle size of 5 μm and an aspect ratio of 20 to 30

Example 87: Moscovite pigment (trademark: Mica A31, made by Yamaguchi Unmokogyosho) having an average particle size of 33 μm and an aspect ratio of 20 to 30

Example 88: Moscovite pigment (trademark: Mica A51, made by Yamaguchi Unmokogyosho) having an average particle size of 45 μm and an aspect ratio of 20 to 30

The test results are shown in Table 12.

Examples 89 to 92

In each of Examples 89 to 92, a moisture-proof paper sheet was produced and tested by the same procedures as in Example 79, except that in the preparation of the coating liquid, the modified SBR latex used in Example 79 as a synthetic resin (a) was replaced by the following compounds.

Example 89: Modified SBR latex (styrene/butadiene comonomer/hydrophilic group-containing comonomer, molar ratio: 58/36/6, trademark: OX1060, made by Nippon Zeon)

Example 90: Modified SBR latex (styrene/butadiene comonomer/hydrophilic group-containing comonomer, molar ratio: 46/34/20, trademark: 686A3, made by Mitsuitoatsu)

Example 91: Acryl/styrene copolymer (trademark: Aron A104, made by Toa Gosei)

Example 92: NBR (trademark: LX550, made by Nippon Zeon).

The test results are shown in Table 12.

Example 93

A mixture was prepared from 50 parts by weight of water, 1 part by weight of a polyaminepolyurea resin (trademark: Sumirez resin 302, made by Sumitomo Kagakukogyo), 0.5 part by weight of N-β-(aminoethyl)-γ-aminopropyltrimetoxy-silane (aminosilane coupling agent, trademark: KBM603, Shinetsu kagakukogyo) and 50 parts by weight of the modified SBR latex (LX407S1X1) having a solid content of 48% by weight, and agitated. Then, the mixture was mixed with 50 parts by weight of the sericite pigment (Sericite KF1325) having an average particle size of 13 μm and an aspect ratio of 20 to 30, while agitating the resultant mixture in a Cowless disperser at an agitation speed of 2000 rpm for 30 minutes, to provide a coating liquid.

The coating liquid was hand-coated, by using a mayer bar, on a surface of an unbleached kraft paper sheet having a basis weight of 70 $g/m^2$, and dried in a hot air circulation dryer at a temperature of 120° C. for one minute, to form a moisture-proof coating layer and to produce a moisture-proof paper sheet.

The test results are shown in Table 13.

Examples 94 to 98

In each of Examples 94 to 98, a moisture-proof paper sheet was produced and tested by the same procedures as in Example 93, except that in the preparation of the coating liquid, the aminosilane coupling agent used in Example 93 was replaced by the following coupling agents.

Example 94: Epoxysilane coupling agent (γ-glycidoxypropyltrimethoxysilane, trademark: KBM403, Shinetsu Kagakukogyo)

Example 95: Vinyl silane coupling agent (Vinyltrimethoxysilane, trademark: KBM1003, made by Shinetsu Kagakukogyo)

Example 96: Methacryloxysilane coupling agent (γ-methacryloxypropyltrimethoxysilane trademark: KBM503, Shinetsu Kagakukogyo)

Example 97: Methylsilane coupling agent (methyltrimethoxysilane, trademark: KBM13, made by Shinetsu Kagakukogyo)

Example 98: Amino titanate coupling agent (isopropyltri (N-aminoethylamino-ethyl) titanate, trademark: KR44, made by Ajinomoto)

The test results are shown in Table 13.

Comparative Example 22

A comparative moisture-proof paper sheet was produced and tested by the same procedures as in Example 79, except that the plate crystalline particles (c) used in Example 79 were replaced by a calcium carbonate pigment (trademark: Softon BF-100, made by Bihoku Funka) having an average particle size of 3.5 μm and an aspect ratio of about 1 to 2.

The test results are shown in Table 12.

TABLE 12

| Example No. | | Plate crystalline particles (b) | Synthetic resin (a) | Moisture-proofness-enhancing agent (c) | Water vapor Permeability ($g/m^2 \cdot 24$ hr) | Re-pulping property (Test method-2) |
|---|---|---|---|---|---|---|
| Example | 79 | Sericite (13 μm) | SBR (LX407S1X1) | Polyaminepolyurea (Sumirez resin 302) | 40 | good |
| | 80 | " | SBR (LX407S1X1) | Polyamidepolyurea (Sumirez resin 633) | 40 | " |
| | 81 | " | SBR (LX407S1X1) | Polyamideaminepolyurea (Sumirez resin 632) | 42 | " |
| | 82 | " | SBR (LX407S1X1) | Polyaminepolyurea (PA-620) | 41 | " |
| | 83 | " | SBR (LX407S1X1) | Polyamideaminepolyurea (PA-622) | 43 | " |
| | 84 | Moscovite (20 μm) | SBR (LX407S1X1) | Polyaminepolyurea (Sumirez resin 302) | 31 | " |
| | 85 | Talc (15 μm) | SBR (LX407S1X1) | Polyaminepolyurea (Sumirez resin 302) | 47 | " |
| | 86 | Moscovite (5 μm) | SBR (LX407S1X1) | Polyaminepolyurea (Sumirez resin 302) | 47 | " |
| | 87 | Moscovite (33 μm) | SBR (LX407S1X1) | Polyaminepolyurea (Sumirez resin 302) | 36 | " |
| | 88 | Moscovite (45 μm) | SBR (LX407S1X1) | Polyaminepolyurea (Sumirez resin 302) | 45 | " |
| Comparative Example | 22 | Calcium carbonate (3.5 μm) | SBR (LX407S1X1) | Polyaminepolyurea (Sumirez resin 302) | 95 | " |
| Example | 89 | Sericite (13 μm) | SBR (0X1060) | Polyaminepolyurea (Sumirez resin 302) | 42 | " |
| | 90 | " | SBR (686A3) | Polyaminepolyurea (Sumirez resin 302) | 43 | " |
| | 91 | " | Acryl (A104) | Polyaminepolyurea (Sumirez resin 302) | 45 | " |
| | 92 | " | NBR (LX550) | Polyaminepolyurea (Sumirez resin 302) | 49 | " |

TABLE 13

| Example No. | Plate crystalline particles (b)/ synthetic resin (a)/ polyaminepolyurea (c) | Coupling agent | Water vapor permeability ($g/m^2 \cdot 24$ hr) | Re-pulping property (Test method-2) |
|---|---|---|---|---|
| 93 | Sericite (13 μm)/ SBR (LX407S1X1)/ Polyaminepolyurea | Aminosilane | 27 | good |
| 94 | Sericite (13 μm)/ SBR (LX407S1X1)/ Polyaminepolyurea | Epoxysilane | 25 | " |
| 95 | Sericite (13 μm)/ SBR (LX407S1X1)/ Polyaminepolyurea | Vinylsilane | 29 | " |
| 96 | Sericite (13 μm)/ SBR (LX407S1X1)/ Polyaminepolyurea | Methacryloxysilane | 30 | " |
| 97 | Sericite (13 μm)/ SBR (LX407S1X1)/ Polyaminepolyurea | Methylsilane | 30 | " |
| 98 | Sericite (13 μm)/ SBR (LX407S1X1)/ Polyaminepolyurea | Aminotitanate | 31 | " |

Tables 12 and 13 show that in the moisture-proof paper sheets of Examples 79 to 98 in accordance with the present invention, the polyaminepolyurea resins, polyamidepolyurea resins and polyamideaminepolyurea resins contained, as a moisture-proofness-enhancing agent, in the coating layers were contributory to enhancing the moisture-proofing property of the resultant coated paper sheet. Also, Table 13 shows that further enhancement of the moisture-proofing property could be attained by using the coupling agents together with the above-mentioned resins. Further, it was confirmed that the moisture-proof paper sheets of Examples 79 to 98 had satisfactory re-pulping properties in practice.

Example 99

A mixture was prepared by mixing, into 50 parts by weight of water, sequentially 0.1 part by weight of ammonia, and 0.5 part by weight of a condensation reaction product of diethylenetriamine, adipic acid and epichlorohydrin (trademark: WS535, made by Nihon PMC), while agitating the mixture. The mixture was further mixed with 50 parts by solid weight of the modified SBR latex (LX407S1X1) having a solid content of 48% by weight, while agitating the mixture.

A coating liquid was prepared by adding, to the mixture, 50 parts by weight of the sericite pigment (Sericite KF1325) having an average particle size of 13 μm and an aspect ratio of 20 to 30, as a plate crystalline phyllosilicate compound particles (b), and agitating the resultant dispersion in a Cowless disperser at an agitating speed of 2000 rpm for 30 minutes.

The coating liquid was hand-coated, by using a mayer bar, on a surface of an unbleached kraft paper sheet having a basis weight of 70 g/m$^2$, and dried in a hot air circulation dryer at a temperature of 120° C. for one minute, to form a moisture-proof coating layer having a dry weight of 30 g/m$^2$.

A moisture-proof paper sheet was obtained.

The test results are shown in Table 14.

Examples 100 to 102

In each of Examples 100 to 102, a moisture-proof paper sheet was produced and tested by the same procedures as in Example 99, except that in the preparation of the coating liquid, the ethylenetriamine-adipic acid-epichlorohydrin condensation reaction product used in Example 99 as a moisture-proofness enhancing agent (c) was replaced by the following compounds.

Example 100: Diallylamine polymer-epichlorohydrin-condensation reaction product (trademark: WS564, made by Nihon PMC)

Example 101: Bishexamethylenetriamine-epichlorohydrin condensation reaction resin (trademark: WS500, made by Nihon PMC)

Example 102: Diethylenetriamine-dicyan-diamide-epichlorohydrin condensation reaction product (trademark: WS515, made by Nihon PMC)

The test results are shown in Table 14.

Examples 103 to 107

In each of Examples 103 to 107, a moisture-proof paper sheet was produced and tested by the same procedures as in Example 99, except that in the preparation of the coating liquid, the sericite pigment (Sericite KF1325) used as a phyllosilicate compound particles (c) in Example 99 was replaced by the following pigments.

Example 103: Moscovite pigment (Mica A21) having an average particle size of 20 μm and an aspect ratio of 20 to 30

Example 104: Talc pigment (Shuen) having an average particle size of 15 μm and an aspect ratio of 5 to 10

Example 105: Moscovite pigment (trademark: Mica A11, made by Yamaguchi Unmokogyosho) having an average particle size of 5 μm and an aspect ratio of 20 to 30

Example 106: Moscovite pigment (trademark: Mica A31, made by Yamaguchi Unmokogyosho) having an average particle size of 33 μm and an aspect ratio of 20 to 30

Example 107: Moscovite pigment (trademark: Mica A51, made by Yamaguchi Unmokogyosho) having an average particle size of 45 μm and an aspect ratio of 20 to 30

Comparative Example 23: Calcium carbonate pigment (Softon BF-100) having an average particle size of 3.5 μm and an aspect ratio of about 1 to 2

The test results are shown in Table 14.

Examples 108 to 111

In each of Examples 109 to 111, a moisture-proof paper sheet was produced and tested by the same procedures as in Example 99, except that in the preparation of the coating liquid, the modified SBR latex used in Example 99 as a synthetic resin (a) was replaced by the following compounds.

Example 108: Modified SBR latex (styrene/butadiene comonomer/hydrophilic group-containing comonomer, molar ratio: 58/36/6, trademark: OX1060, made by Nippon Zeon)

Example 109: Modified SBR latex (styrene/butadiene comonomer/hydrophilic group-containing comonomer, molar ratio: 46/34/20, trademark: 686A3, made by Mitsuitoatsu)

Example 110: Acryl/styrene copolymer (trademark: Aron A104, made by Toa Gosei)

Example 111: NBR (trademark: LX550, made by Nippon Zeon)

The test results are shown in Table 14.

Example 112

A mixture was prepared from 50 parts by weight of water, 0.1 part of ammonia, 0.5 part by weight of the diethylenetriamine-adipic acid-epichlorohydrin condensation reaction product (W5535) and 0.5 part by weight of N-β(aminoethyl)γ-aminopropyltrimethoxysilane (amino coupling agent, trademark:KBM603, made by Shinetsu Kagakukogyo), with stirring, and then further mixed with 50 parts by solid weight of the modified SBS latex (LX407S1X1) having a solid content of 48% by weight, as a synthetic resin (a).

A coating liquid was prepared by mixing the resultant mixture with 50 parts by weight of the sericite pigment (Sericite KF1325) having an average particle size of 13 μm and an aspect ratio of 20 to 30, in a Cowless disperser at an agitating speed of 2000 rpm for 30 minutes.

The coating liquid was hand coated on a surface of an unbleached kraft paper sheet having a basis weight of 70 g/m$^2$, by using a mayer bar, and the coating liquid layer was dried in a hot air circulation dryer at a temperature of 120° C. for one minute to provide a moisture-proof coating layer.

A moisture-proof paper sheet was obtained.

The test results are shown in Table 15.

Examples 113 to 118

In each of Examples 113 to 118, a moisture-proof paper sheet was produced and tested by the same procedures as in Example 112, except that in the preparation of the coating liquid, the aminosilane coupling agent used in Example 112 was replaced by the following coupling agents.

Example 113: Epoxysilane coupling agent (γ-glycidoxypropyltrimethoxysilane, trademark: KBM403, Shinetsu Kagakukogyo)

Example 114: Vinyl silane coupling agent (Vinyltrimethoxysilane, trademark: KBM1003, made by Shinetsu Kagakukogyo)

Example 115: Methacryloxysilane coupling agent (γ-methacryloxypropyltrimethoxysilane trademark: KBM503, Shinetsu Kagakukogyo)

Example 116: Methylsilane coupling agent (methyltrimethoxysilane, trademark: KBM13, made by Shinetsu Kagakukogyo)

Example 117: Amino titanate coupling agent (isopropyltri (N-aminoethylamino-ethyl)titanate, trademark: KR44, made by Ajinomoto)

The test results are shown in Table 15.

TABLE 14

| Example No. | | Plate crystalline particles (b) | Synthetic resin (a) | Moisture-proofness-enhancing agent (c) | Water vapor permeability ($g/m^2 \cdot 24$ hr) | Re-pulping property (Test method-2) |
|---|---|---|---|---|---|---|
| Example | 99 | Sericite (13 μm) | SBR (LX407S1X1) | WS535 | 41 | good |
| | 100 | Sericite (13 μm) | SBR (LX407S1X1) | WS564 | 44 | " |
| | 101 | Sericite (13 μm) | SBR (LX407S1X1) | WS500 | 43 | " |
| | 102 | Sericite (13 μm) | SBR (LX407S1X1) | WS515 | 46 | " |
| | 103 | Moscovite (20 μm) | SBR (LX407S1X1) | WS535 | 34 | " |
| | 104 | Talc (15 μm) | SBR (LX407S1X1) | " | 48 | " |
| | 105 | Moscovite (5 μm) | SBR (LX407S1X1) | " | 50 | " |
| | 106 | Moscovite (33 μm) | SBR (LX407S1X1) | " | 37 | " |
| | 107 | Moscovite (45 μm) | SBR (LX407S1X1) | " | 45 | " |
| Comparative Example | 23 | Calcium carbonate (3.5 μm) | SBR (LX407S1X1) | " | 95 | " |
| Example | 108 | Sericite (13 μm) | SBR (0X1060) | " | 45 | " |
| | 109 | Sericite (13 μm) | SBR (686A3) | " | 43 | " |
| | 110 | Sericite (13 μm) | Acryl (A104) | " | 46 | " |
| | 111 | Sericite (13 μm) | NBR (LX550) | " | 48 | " |

TABLE 15

| Example No. | Plate crystalline particles (b)/ synthetic resin (a)/ moisture proofness-enhancing agent (c) | Coupling agent | Water vapor permeability ($g/m^2 \cdot 24$ hr) | Re-pulping property (Test method-2) |
|---|---|---|---|---|
| 112 | Sericite (13 μm)/ SBR (LX407S1X1)/ WS535 | Aminosilane | 28 | good |
| 113 | Sericite (13 μm)/ SBR (LX407S1X1)/ WS535 | Epoxysilane | 26 | " |
| 114 | Sericite (13 μm)/ SBR (LX407S1X1)/ WS535 | Vinylsilane | 29 | " |
| 115 | Sericite (13 μm)/ SBR (LX407S1X1)/ WS535 | Methacryloxysilane | 29 | " |
| 116 | Sericite (13 μm)/ SBR (LX407S1X1)/ WS535 | Methylsilane | 30 | " |
| 117 | Sericite (13 μm)/ SBR (LX407S1X1)/ WS535 | Amino titanate | 30 | " |

Tables 14 and 15 show that in the moisture-proof paper sheets of Examples 99 to 117 in accordance with the present invention, the condensation reaction products of polyamine compounds or polyamide compounds with epihalohydrin, contained, as a moisture-proofness-enhancing agent, in the coating layers are contributory to enhancing the moisture-proofing property of the resultant coated paper sheets. Also, Table 15 shows that further enhancement of the moisture-proofing property could be attained by using the coupling agents together with the above-mentioned resins. Further, it was confirmed that the moisture-proof paper sheets of Examples 99 to 117 had a satisfactory re-pulping property in practice.

Example 118

A glycidoxysilane coupling agent (trademark: KBM403, made by Shinetsu Kagakukogyo) was dissolved in a concentration of 10% by weight in toluene. The coupling agent solution in an amount of 10 parts by weight was added dropwise to 100 parts by weight of a moscovite pigment (trademark: Mica A21 made by Yamaguchi Unmokogyosho) having an average particle size of 20 μm and an aspect ratio of 20 to 30 and dried at a temperature of 120° C. for one hour, agitating the mixture at an agitating speed of 1000 rpm for 10 minutes, and then the mixture was dried at a temperature of 80° C. for 2 hours to provide a coupling agent surface-treated moscovite pigment (a).

The coupling agent surface-treated moscovite pigment (a) in an amount of 100 parts by weight was mixed into 100 parts by weight of water and 0.2 parts by weight of a polyacrylic acid dispersing agent (trademark: Carribon L400, made by Toa Gosei) in a Cowless disperser at an agitation speed of 2000 rpm for 30 minutes.

The resultant dispersion was mixed with the carboxylic acid-modified SBR latex (LX407S1X1) in a solid weight mixing ratio of 50/50, and then with 1 part by solid weight of a melamine-formaldehyde condensation reaction product (trademark: U-RAMIN P-6300, made by Mitsuitoatsu), to provide a coating liquid.

The coating liquid was coated on a surface of an unbleached kraft paper sheet having a basis weight of 70 g/m$^2$, by using a mayer bar, and the coating liquid layer was dried at a temperature of 110° C. for 2 minutes to form a moisture-proof coating layer having a dry weight of 20 g/m$^2$.

A moisture-proof paper sheet was obtained.

The test results are shown in Table 16.

Example 119

A methacryloxysilane coupling agent (trademark: KBM503, made by Shinetsu Kagakukogyo) was dissolved in a concentration of 10% by weight in toluene. The coupling agent solution in an amount of 10 parts by weight was added dropwise to 100 parts by weight of a moscovite pigment (trademark: Mica A21 made by Yamaguchi Unmokogyosho) having an average particle size of 20 μm and an aspect ratio of 20 to 30 and dried at a temperature of 120° C. for one hour, agitating the mixture at an agitating speed of 1000 rpm for 10 minutes, and then the mixture was dried at a temperature of 80° C. for 2 hours to provide a coupling agent surface-treated moscovite pigment (b).

The coupling agent surface-treated moscovite pigment (b) in an amount of 100 parts by weight was mixed into 95 parts by weight of water, 5 parts by weight of isopropyl alcohol and 0.2 parts by weight of a polyacrylic acid dispersing agent (trademark: Carribon L400, made by Toa Gosei) in a Cowless disperser at an agitation speed of 2000 rpm for 30 minutes.

The resultant dispersion was mixed with the carboxylic acid-modified SBR latex (LX407S1X1) in a solid weight mixing ratio of 50/50, and then with 1 part by solid weight of a polyamide resin (trademark: Sumirez resin 5001, made by Sumitomo Kagakukogyo), to provide a coating liquid.

The coating liquid was coated on a surface of an unbleached kraft paper sheet having a basis weight of 70 g/m$^2$, by using a mayer bar, and the coating liquid layer was dried at a temperature of 110° C. for 2 minutes to form a moisture-proof coating layer having a dry weight of 20 g/m$^2$.

A moisture-proof paper sheet was obtained.

The test results are shown in Table 16.

Example 120

A sericite pigment (trademark: Sericite KF1325, made by Chuo Kaolin) having an average particle size of 13 μm and an aspect ratio of 20 to 30 was dispersed in an amount of 100 parts by weight in 100 parts by weight of water. The resultant dispersion was added dropwise to 1 part by weight of a stearoyl titanate coupling agent (trademark: KRET, made by Ajinomoto), while agitating the mixture in a Cowless disperser at an agitation speed of 2000 rpm for 30 minutes.

To this dispersion, 100 parts by solid weight of the modified SBR latex (LX407S1X1) and then 2 parts by solid weight of glyoxal (made by Wako Junyaku) were mixed, to provide a coating liquid.

A moisture-proof paper sheet was produced from the coating liquid in the same manner as in Example 118.

The test results are shown in Table 16.

Example 121

A moisture-proof paper sheet was produced and tested by the same procedures as in Example 120, except that the glyoxal was replaced by sorbitol polyglycidyl ether (trademark: Denacol EX614B, made by Nagase Kasei) and the modified SBR (LX407S1X1) was replaced by a styrene-butadiene-carboxylic acid containing comonomer copolymer (trademark: JO619, made by Nihon Goseigomu) having a solid content of 48% by weight and a carboxylic acid-modification of 4%.

The test results are shown in Table 16.

TABLE 16

| Example No. | Plate crystalline particles (b) | Synthetic resin (a) | Moisture proofness-enhancing agent (c): Coupling agent | Cross-linking compound | Water vapor permeability (g/m$^2$ · 24 hr) | Re-pulping property (Test method-1) | Blocking resistance |
|---|---|---|---|---|---|---|---|
| 118 | Moscovite (20 μm) | Modified SBR (LX407) | KBM403 | P6 300 | 40 | good | 3 |
| 119 | Moscovite (20 μm) | Modified SBR (LX407) | KBM503 | 5001 | 38 | " | 3 |
| 120 | Sericite (13 μm) | Modified SBR (LX407) | KRET | glyoxal | 38 | " | 3 |
| 121 | Sericite (13 μm) | Modified SBR (J0619) | " | EX 614B | 39 | " | 3 |

Table 16 shows that the moisture-proof paper sheets of Examples 118 to 121 in accordance with the present invention exhibited a good moisture-proofing property and a high blocking resistance, due to the use of the moisture-proofness-enhancing agents (c) comprising a cross-linking compound and a coupling agent. Also, all the moisture-proof paper sheets of Examples 118 to 121 exhibited a satisfactory re-pulping property for practice.

Example 122

An aqueous solution of a copolymer of methyl methacrylate, ethyl acrylate and methacrylic acid in a molar ratio of 51:26:23 and having a Tg of 65° C. was neutralized with an aqueous ammonia solution into a pH value of 117.

Separately, 100 parts by weight of a moscovite pigment (trademark: Mica AB32, made by Yamaguchi Unmokogyosho) having an average particle size of 22 μm and an aspect ratio of 20 to 30 were dispersed in 100 parts by weight of water in a Cowless disperser at an agitation speed of 2000 rpm for 2 hours.

A coating liquid was prepared by mixing 50 parts by solid weight of the neutralized resin solution and 50 parts by solid weight of the moscovite dispersion, and hand-coated on a surface of an unbleached kraft paper sheet by using a mayer bar and the resultant coating liquid layer was dried in a hot air circulation dryer at a temperature of 110° C. for 2 minutes, to form a coating layer having a dry weight of 15 g/m$^2$. A moisture-proof paper sheet was obtained.

The test results are shown in Table 17.

Examples 123 to 124

In each of Examples 122 and 123, a moisture-proof paper sheet was produced and tested by the same procedures as in Example 122, except that in the preparation of the coating liquid, the moscovite pigment (Mica AB32) used in Example 122 was replaced by the following pigments.

Example 123: Moscovite pigment (trademark: Mica FA500, made by Yamaguchi Unmokogyosho) having an average particle size of 18 μm and an aspect ratio of 20 to 30

Example 124: Moscovite pigment (trademark: Mica special A30, made by Yamaguchi Unmokogyosho) having an average particle size of 22 μm and an aspect ratio of 20 to 30

The test results are shown in Table 17.

Example 125

A moisture-proof paper sheet was produced and tested by the same procedures as in Example 122, except that the moscovite pigment (Mica AB32) was mixed in an amount of 60 parts by weight with the ammonia-neutralized copolymer in an amount of 40 parts by weight.

The test results are shown in Table 17.

Example 126

A moisture-proof paper sheet was produced and tested by the same procedures as in Example 122, except that the moscovite pigment (Mica AB32) was mixed in an amount of 30 parts by weight with the ammonia-neutralized copolymer in an amount of 70 parts by weight.

The test results are shown in Table 17.

Example 127

A moisture-proof paper sheet was produced and tested by the same procedures as in Example 122, except that in the preparation of the coating liquid, the moscovite pigment (Mica AB32) was used in an amount of 50 parts by weight, the ammonia-neutralized copolymer was used in an amount of 49 parts by weight, and glycerol polyglycidyl ether (trademark: Denacol EX313, made by Nagase Kasei) was further added in an amount of 1.0 part by weight.

The test results are shown in Table 17.

TABLE 17

| Example No. | Synthetic resin (a) | Moisture-proofness-enhancing agent (c) | Plate crystalline particles (b) | Mixing weight ratio (a) + (c)/(b) | Cross-linking agent | Water vapor permeability (g/m$^2$ · 24 hr) | Re-pulping property (Test method-1) |
|---|---|---|---|---|---|---|---|
| 122 | MMA/EA/MA colymer | Ammonia | AB32 | 50/50 | — | 41 | good |
| 123 | MMA/EA/MA colymer | " | FA500 | " | — | 36 | " |
| 124 | MMA/EA/MA colymer | " | Special A30 | " | — | 39 | " |
| 125 | MMA/EA/MA colymer | " | AB32 | 40/60 | — | 32 | " |
| 126 | MMA/EA/MA colymer | " | " | 70/30 | — | 47 | " |
| 127 | MMA/EA/MA colymer | " | " | 49/50 | glycerol glycidyl ether (1 part) | 28 | " |

Note (1) MMA/EA/MA colymer = Methyl methacrylate-ethylacrylate-methacrylic acid (51/26/23) copolymer Table 17 shows that the moisture-proof paper sheets of Examples 122 to 127 produced in accordance with the present invention exhibited a satisfactory moisture-proofing performance and a sufficient re-pulping property.

What we claim is:

1. A moisture-proof paper sheet comprising a paper sheet substrate and a moisture-proof coating layer formed on at least one surface of the paper sheet substrate, the moisture-proof coating layer comprising:

(a) a moisture-proof and film-forming synthetic resin;

(b) plate crystalline phyllosilicate compound particles having an average particle size of 5 to 50 μm and an aspect ratio of 5 or more; and (c) a moisture-proofness-enhancing agent.

2. The moisture-proof paper sheet as claimed in claim 1, wherein the moisture-proof and film-forming synthetic resin (a) comprises at least one member selected from the group consisting of:

(a-1) polymers and copolymers of at least one monomer selected from the group consisting of conjugated diene compounds having 4 to 6 carbon atoms, acrylic acid esters having 4 to 11 carbon atoms, methacrylic acid esters having 5 to 12 carbon atoms, ethylenically unsaturated nitrile compounds having 3 to 4 carbon atoms, ethylenically unsaturated carboxylic acid glycidyl esters having 6 or 7 carbon atoms and aromatic vinyl compounds having 8 to 11 carbon atoms, and (a-2) copolymers of at least one hydrophobic comonomer selected from the group consisting of conjugated diene compounds having 4 to 6 carbon atoms, acrylic acid esters having 4 to 11 carbon atoms, methacrylic acid esters having 5 to 12 carbon atoms, ethylenically unsaturated nitrile compounds having 3 to 4 carbon atoms, ethylenically unsaturated carboxylic acid glycidyl esters having 5 to 6 carbon atoms, and aromatic vinyl compounds having 8 to 11 carbon atoms, with at least one hydrophilic comonomer selected from the group consisting of ethylenically unsaturated carboxylic acids having 3 to 7 carbon atoms and ethylenically unsaturated carboxylic acid amides having 3 to 9 carbon atoms.

3. The moisture-proof paper sheet as claimed in claim 1, wherein the moisture-proofness-enhancing agent (c) comprises at least one member selected from the group consisting of:

urea-formaldehyde condensation reaction products, melamine-formaldehyde condensation reaction products, aldehyde compounds having 1 to 8 carbon atoms, epoxy compounds having at least one epoxy group, cross-linkable multivalent metal compounds, organoalkoxysilane compounds, organoalkoxyl metal compounds, organic amine compounds, ammonia, polyamide compounds, polyamidepolyurea compounds, polyaminepolyurea compounds, polyamideaminepolyurea compounds, polyamideamine compounds, condensation reaction products of polyamideamine compounds with epihalohydrines or formaldehyde, condensation reaction products of polyamine compounds with epihalohydrines or formaldehyde, condensation reaction products of polyamidepolyurea compounds with epihalohydrines or formaldehyde, condensation reaction products of polyaminepolyurea compounds with epihalohydrines or formaldehyde, and condensation reaction products of polyamideaminepolyurea compounds with epihalohydrines or formaldehyde.

4. The moisture-proof paper sheet as claimed in claim 2, wherein the moisture-proofness-enhancing agent (c) comprises a compound capable of cross-linking the moisture-proof and film-forming synthetic resin (a) with covalent bonds, to hydrophobilize the synthetic resin (a).

5. The moisture-proof paper sheet as claimed in claim 2, wherein the moisture-proofness-enhancing agent (c) comprises a compound capable of cross-linking the moisture-proof and film-forming synthetic resin (a) with ionic bonds, to hydrophobilize the synthetic resin (a).

6. The moisture-proof paper sheet as claimed in claim 2, wherein the moisture-proofness-enhancing agent (c) comprises a compound capable of cross-linking the moisture proof and film-forming synthetic resin (a) with coordination bonds, to hydrophobilize the synthetic resin (a).

7. The moisture-proof paper sheet as claimed in claim 3, wherein at least one member selected from the group consisting of organoalkoxysilane compounds and organoalkoxyl metal compounds is carried on the surfaces of the phyllosilicate compound particles.

8. The moisture-proof paper sheet as claimed in claim 1, wherein the moisture-proof and film-forming synthetic resin (a) and the phyllosilicate compound particles (b) are present in a solid weight ratio (a)/(b) of 30/70 to 70/30, and the moisture-proofness-enhancing agent (c) is present in an amount of 0.05 to 10 parts by weight par 100 parts by weight of the moisture proof and film-forming synthetic resin (a).

* * * * *